US010450790B1

(12) United States Patent
Luvison

(10) Patent No.: US 10,450,790 B1
(45) Date of Patent: Oct. 22, 2019

(54) BRICKMOULD WINDOW TRIM

(71) Applicant: Associated Materials, LLC, Cuyahoga Falls, OH (US)

(72) Inventor: Michael Luvison, Cuyahoga Falls, OH (US)

(73) Assignee: Associated Materials, LLC, Cuyahoga Falls, OH (US)

( * ) Notice: Subject to any disclaimer, the term of this patent is extended or adjusted under 35 U.S.C. 154(b) by 0 days.

(21) Appl. No.: 16/130,802

(22) Filed: Sep. 13, 2018

(51) Int. Cl.
*E06B 1/34* (2006.01)
*E06B 1/62* (2006.01)

(52) U.S. Cl.
CPC ..... *E06B 1/345* (2013.01); *E06B 1/62* (2013.01)

(58) Field of Classification Search
CPC ..... E06B 1/345; E06B 1/62
See application file for complete search history.

(56) References Cited

U.S. PATENT DOCUMENTS 5,018,325 A * 5/1991 Geen ..... E06B 1/62 52/211
5,651,222 A * 7/1997 Bridges ..... E06B 1/34 52/211
5,669,192 A * 9/1997 Opdyke ..... E06B 1/34 52/211
6,631,595 B1 * 10/2003 Minter ..... E06B 1/62 49/504
8,776,461 B2 * 7/2014 Carlson ..... E06B 3/4618 52/204.55
2007/0094958 A1 * 5/2007 Rogers ..... E06B 1/62 52/211
2007/0277455 A1 * 12/2007 Flanigan ..... E06B 1/62 52/206
2010/0251643 A1 * 10/2010 Rosende ..... E06B 1/6015 52/204.2
2012/0222383 A1 * 9/2012 Cashman ..... E04F 13/06 52/717.01

* cited by examiner

*Primary Examiner* — Paola Agudelo
(74) *Attorney, Agent, or Firm* — Knobbe, Martens, Olson & Bear LLP

(57) ABSTRACT

A brickmold window trim can include a single-piece body that can be installed by hand on a window frame without tools. The brickmold window trim resiliently couples to the window frame, is self-retaining on the window frame, and self-centering relative to the window frame. The brickmold window trim can have a flange that contact a top surface of a ledge portion of a window frame, a support wall that contacts a side surface of the ledge portion and an angled wall portion that contacts an underside of the ledge portion. One or more of the flange wall, support wall and angled wall snaps or clips onto the ledge portion to couple the brickmold window trim to the window frame.

28 Claims, 18 Drawing Sheets

BRICKMOULD WINDOW TRIM

BACKGROUND

Field

Aspects of the present disclosure are directed to a window trim, and more particularly to a self-retaining brickmould window trim frame.

Description of the Related Art

A brickmould trim provides the exterior trim to a window. Traditional wood brickmould trim, when subjected to weather over a prolonged period of time, can wear or rot, requiring replacement. Additionally, window installation (either in new constructions, or when replacing windows in an existing home) often will include installation of a brickmould trim to frame the exterior of the window.

Conventional brickmould trim design, often made of wood, makes installation complex. Often, such installation requires careful measurement of the opening around the window, cutting the brickmould pieces precisely and with a 45-degree angle at the ends so that the brickmould pieces can mate to define a frame around the window. Additionally, the brickmould trim made of wood needs to be painted and then nailed in place (e.g., into studs of the wall the window is installed in). Finally, caulking is applied where the brickmould meets the siding to keep rainwater from seeping into the crevices between the brickmould trim and the siding. Such an installation process can be time consuming, sometimes taking about two hours to complete, adding to the cost (e.g., labor and materials) of replacing a window. Additionally, because of their complexity, such installations require expert window installers to complete the work. Due to the amount of time and level of experience such installations often require, they limit the number of window installations a window installer can complete in a work day.

SUMMARY

Accordingly, there is a need for an improved brickmould trim that does not have some of the drawbacks noted above for conventional brickmould trim.

In accordance with one aspect of the disclosure, a single-piece brickmould window trim is provided that can be installed by hand on a window frame.

In accordance with another aspect of the disclosure, a single-piece brickmould window trim is provided that can be installed by hand on a window frame without the use of tools.

In accordance with another aspect of the disclosure, a brickmould window trim frame is provided that can be resiliently installed around a window frame, wherein the brickmould window trim frame is self-retaining on the window frame (e.g., without the need for separate fasteners, such as screws, nails, glue, etc. to attach the brickmould window trim to the window frame).

In accordance with another aspect of the disclosure, a brickmould window trim frame is provided that can be resiliently installed around a window frame, wherein the brickmould window trim frame is self-centering on the window frame.

In accordance with another aspect of the disclosure, a brickmould window trim frame is provided that resiliently snaps onto a window frame, and can be installed by hand (e.g., by a single person, without tools).

In accordance with another aspect of the disclosure, a brickmould window trim frame is provided. The brickmould window trim frame comprises a single-piece body having a left frame portion, a right frame portion, a top frame portion and a bottom frame portion. Each of the frame portions comprises a brickmould body, a flange wall, a support wall and an angled wall. The flange wall is attached to the brickmould body and extends inwardly from the brickmould body. The support wall is attached to one or both of the flange wall the brickmould body and extends to a distal edge, the support wall being disposed below the flange wall and extending transversely relative to the flange wall. The angled wall extends at an acute angle from the distal edge of the support wall toward the flange wall so that a cross-section of the flange wall, support wall and angled wall is generally c-shaped. The single-piece body is configured to couple to a window frame over an outer perimeter ledge of the window frame so that the flange wall contacts a top surface of the outer perimeter ledge, the support wall contacts a side surface of the outer perimeter ledge, and the angled wall contacts an underside of the outer perimeter ledge, the single-piece body configured to be installed on the window frame by hand.

In accordance with another aspect of the disclosure, in combination with a window frame, a single-piece brickmould window trim is provided. The brickmould window trim comprises a brickmould body, a flange wall, a support wall and an angled wall. The flange wall is attached to the brickmould body and extends inwardly from the brickmould body. The support wall is attached to one or both of the flange wall the brickmould body and extends to a distal edge, the support wall being disposed below the flange wall and extending transversely relative to the flange wall. The angled wall extends at an acute angle from the distal edge of the support wall toward the flange wall so that a cross-section of the flange wall, support wall and angled wall is generally c-shaped. The single-piece body is configured to couple to a window frame over an outer perimeter ledge of (or attached to) the window frame so that the flange wall contacts a top surface of the outer perimeter ledge, the support wall contacts a side surface of the outer perimeter ledge, and the angled wall contacts an underside of the outer perimeter ledge, the single-piece body configured to be installed on the window frame by hand. Optionally, the outer perimeter ledge is provided by an adapter block that couples to an accessory groove of the window frame.

In accordance with another aspect of the disclosure, a brickmould window trim frame is provided. The trim frame comprises a single-piece body having a left frame portion, a right frame portion and a top frame portion. Each of the frame portions comprises a brickmould body, a support wall extending generally transversely to the brickmould body to a distal edge located past a bottom surface of the brickmould body, and a hook portion extending from the distal edge of the support wall. The single-piece body is configured to couple to a window frame over an outer perimeter ledge of (or attached to) the window frame so that the support wall contacts a side surface of the outer perimeter ledge, and the hook portion contacts an underside of the outer perimeter ledge, the single-piece body configured to be installed on the window frame by hand. Optionally, the outer perimeter ledge is provided by an adapter block that couples to an accessory groove of the window frame.

In accordance with another aspect of the disclosure, in combination with a window frame, a single-piece brickmould window trim frame is provided. The brickmould window trim frame comprises a single-piece body having a left frame portion, a right frame portion and a top frame portion. Each of the frame portions comprises a brickmould body, a support wall extending generally transversely to the brickmould body to a distal edge located past a bottom surface of the brickmould body, and a hook portion extending from the distal edge of the support wall. The single-piece body is configured to couple to a window frame over an outer perimeter ledge of (or attached to) the window frame so that the support wall contacts a side surface of the outer perimeter ledge, and the hook portion contacts an underside of the outer perimeter ledge, the single-piece body configured to be installed on the window frame by hand. Optionally, the outer perimeter ledge is provided by an adapter block that couples to an accessory groove of the window frame.

DETAILED DESCRIPTION

Figure 1:
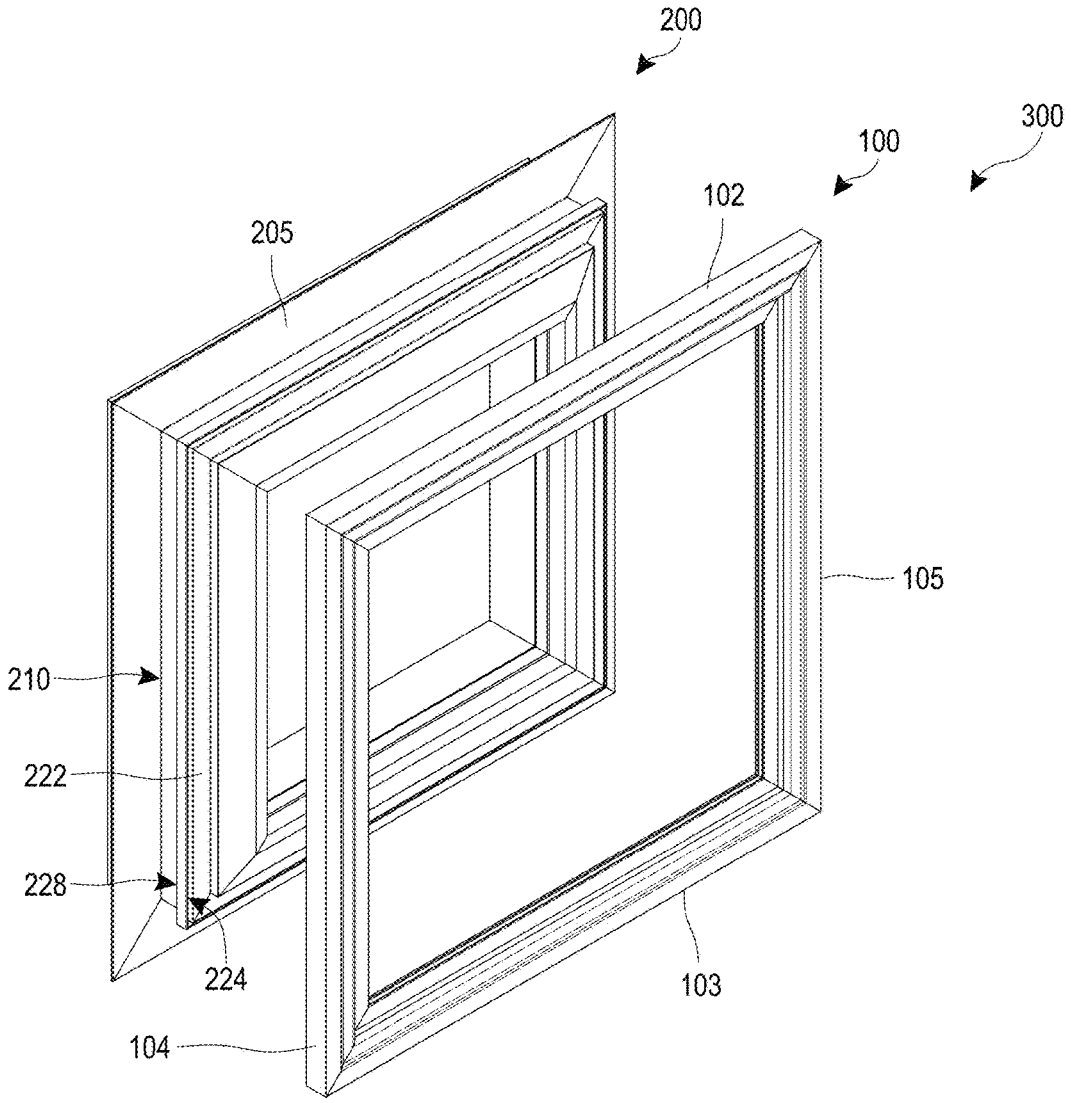
FIG. 1 is a perspective exploded view of a window frame and a brickmould window trim frame.
Figure 2:
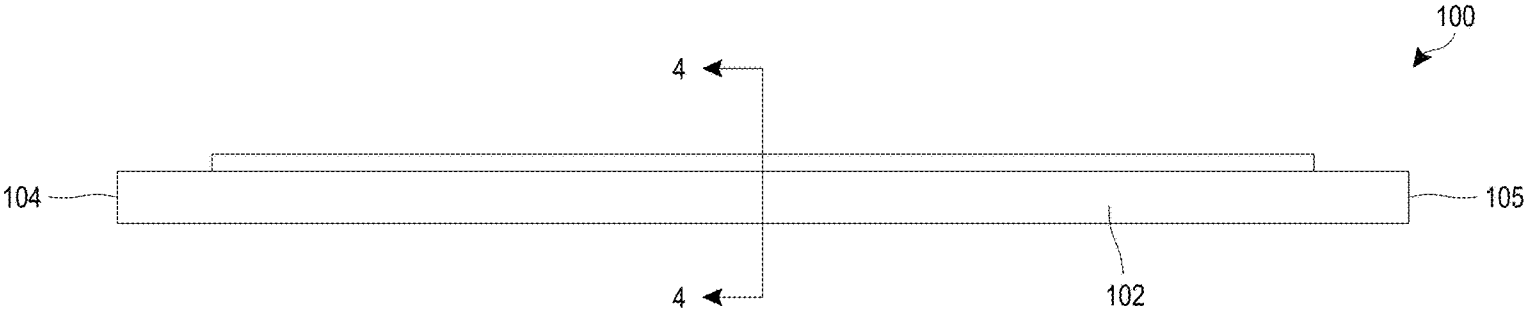
FIG. 2 is a top view of the brickmould window trim frame of FIG. 1.
Figure 3:
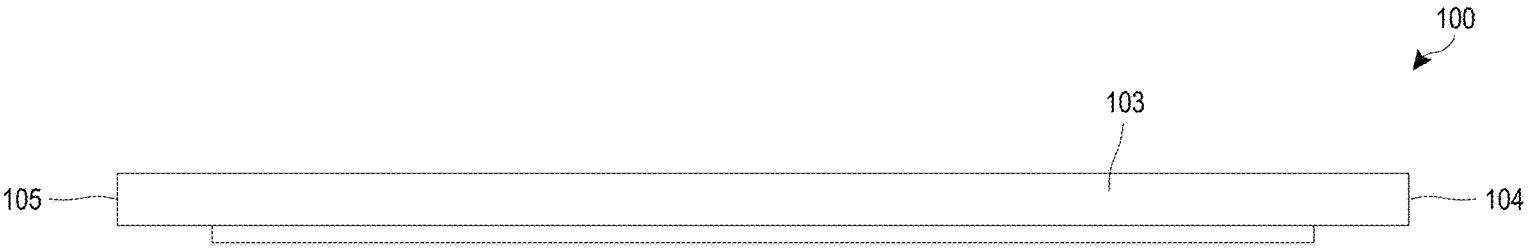
FIG. 3 is a bottom view of the brickmould window trim frame of FIG. 1.

FIGS. 1-6 show a brickmould window trim frame 100 that can be installed on a window frame 200, as discussed further below, to provide a window assembly 300 with a brickmould trim.

The window frame 200 optionally includes a nailing flange 205 and a frame 210 spaced apart from the nailing flange 205 by a side wall 230. In the illustrated embodiment, the widow frame 200 can be a picture window frame 200. The frame 210 can have a ledge portion 220 that protrudes outward relative to the side wall 230 (e.g., the ledge portion 220 has a perimeter that is larger than a perimeter of the side wall 230). One or both of the frame 210 and ledge portion 220 have a top (e.g., front) surface 222, and a groove 224 (e.g., accessory groove) on the top surface 222. The ledge portion 220 has a side surface 226 that defines an outer perimeter that is greater than an outer perimeter of the side wall 230. The ledge portion 220 also has an underside 228 on an opposite side of the ledge portion 220 from the top surface 222. Optionally, the underside 228 can have a flat surface. In another implementation, the underside 228 can have a groove. In still another implantation, the underside 228 can have a gap or opening between the side surface 226 and the side wall 230.

The brickmould window trim frame 100 has a top frame member 102, a bottom frame member 103, a left-side frame member 104 and a right-side frame member 105 that together define a single piece (e.g., monolithic, integral) frame. The frame members 102-105 are optionally straight. Optionally, one or more of the frame members 102-105 is curved (e.g., where the window frame 200 is curved to accommodate a curved window). Optionally, the frame members 102-105 are welded to each other to form the integral trim frame 100. Optionally, the top and bottom frame members 102-103 are generally parallel to each other, and the left-side and right-side frame members 104-105 are generally parallel to each other.

Optionally, the brickmould window trim frame 100 is made of a thermoplastic material. In one implementation, the brickmould window trim frame 100 is made of polyvinyl chloride (PVC) material.

Each of the frame members 102-105 has a brickmould body 110, a flange 120 that extends inward toward the window frame 210, a support wall 130 and a hook portion 140. Optionally, the brickmould body 110, flange 120, support wall 130 and hook portion 140 are a single piece (e.g., monolithic, seamless). The brickmould body 110 of each of the frame members 102-105 can be connected to define a single integral brickmould member. The flange 120 of each of the frame members 102-105 is optionally connected to define a single integral flange member. The support wall 130 of each of the frame members 102-105 is separate from each other (e.g., not connected together), allowing each support wall 130 to move (e.g., flex) independently of each other. The hook portion 140 of each of the frame members 102-105 is separate from each other (e.g., not connected together), allowing each hook member 140 to move (e.g., flex) independently of each other.

Figure 4:
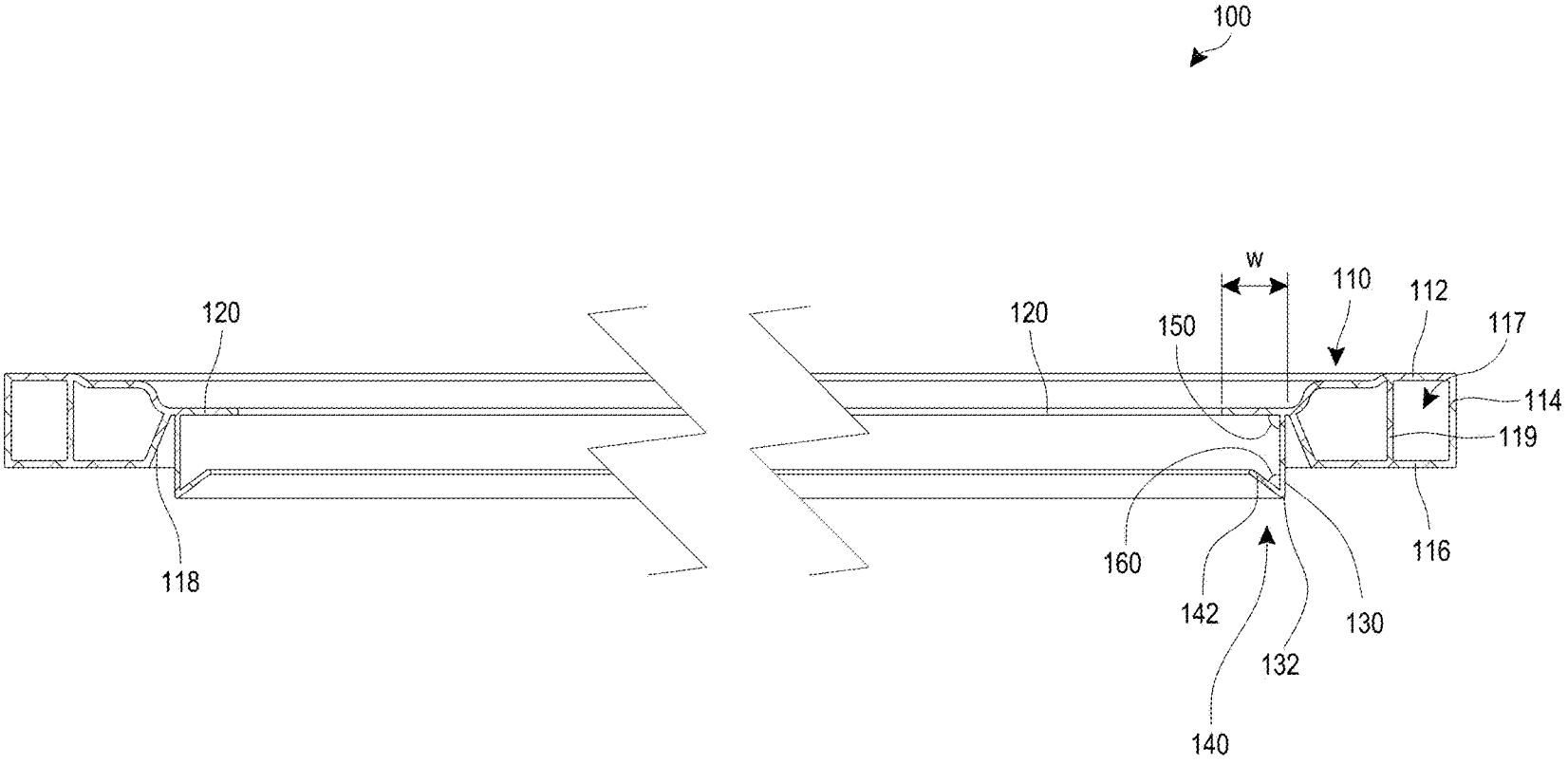
FIG. 4 is a cross-sectional side view of the brickmould window trim frame of FIG. 1, taken through line 4-4 shown in FIG. 2.
Figure 6:
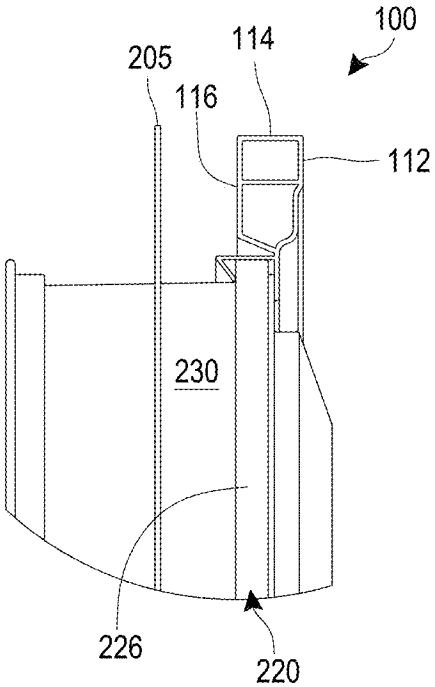
FIG. 6 is a detailed view of a portion of the cross-sectional side view of FIG. 5.
Figure 5:
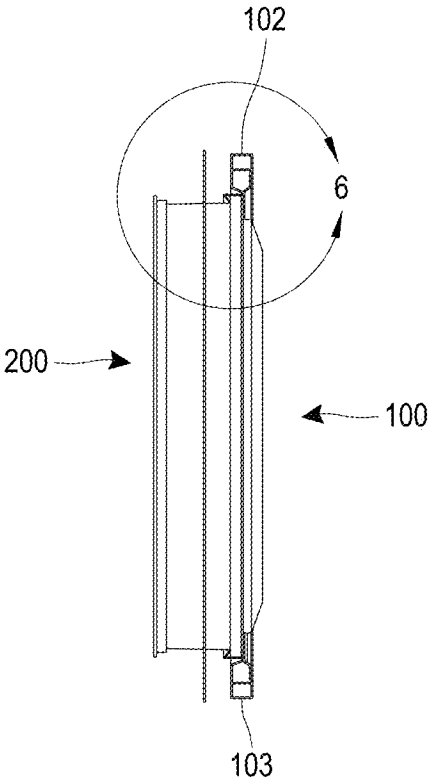
FIG. 5 is a cross-sectional side view of the window frame assembled with the brickmould window trim frame of FIG. 1.
Figure 7:
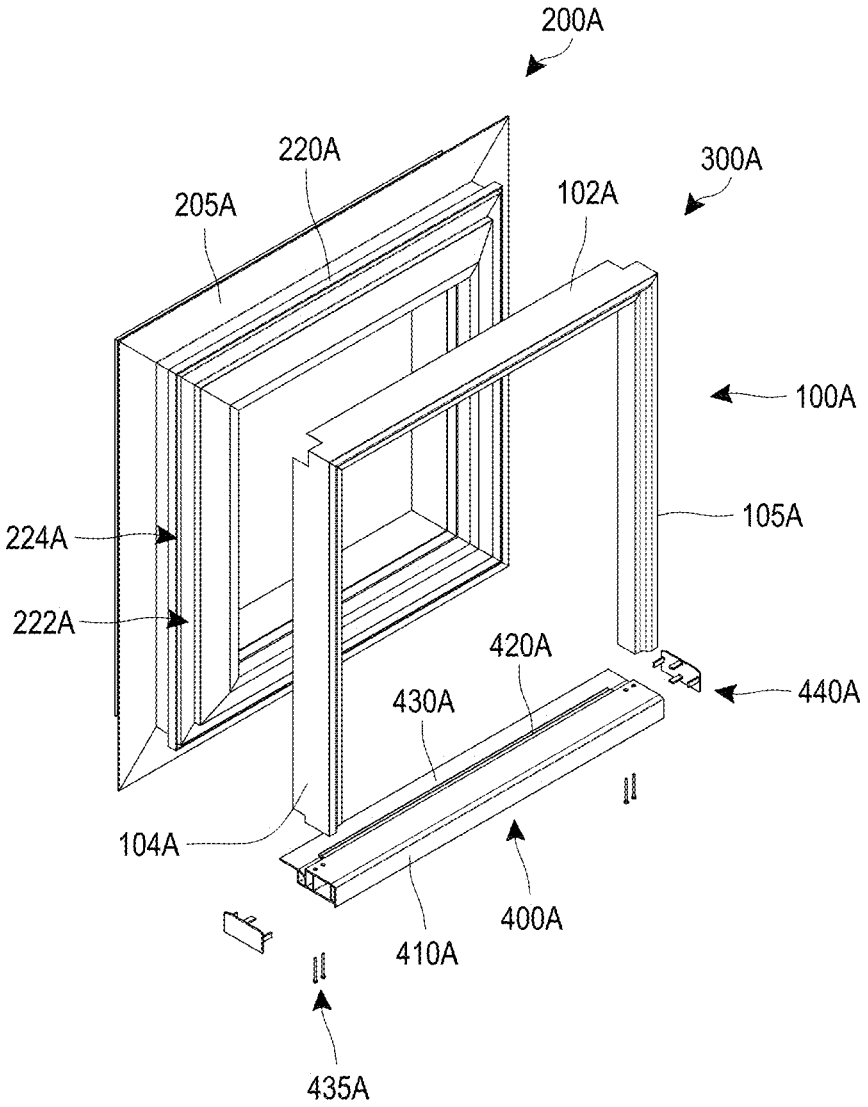
FIG. 7 is a perspective exploded view of a window frame and a brickmould window trim frame.
Figure 10:
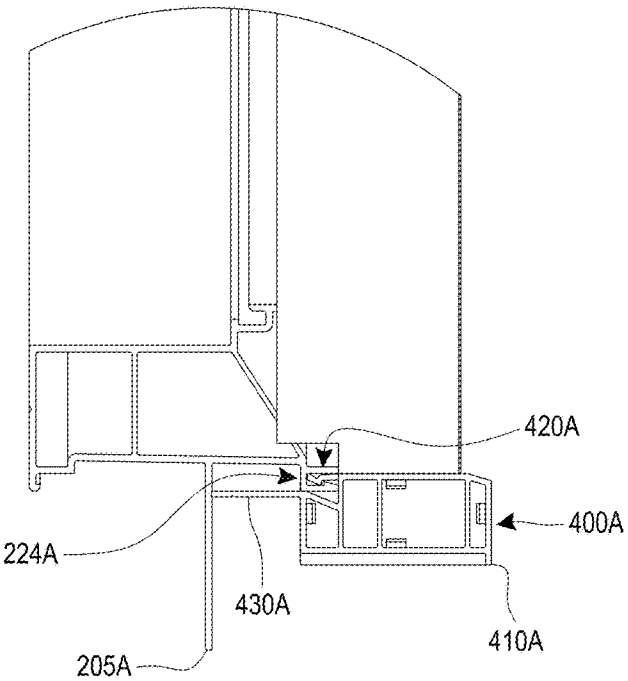
FIG. 10 is a detailed view of another portion of the cross-sectional side view of the window frame and brickmould window trim frame of FIG. 7 assembled together.
Figure 9:
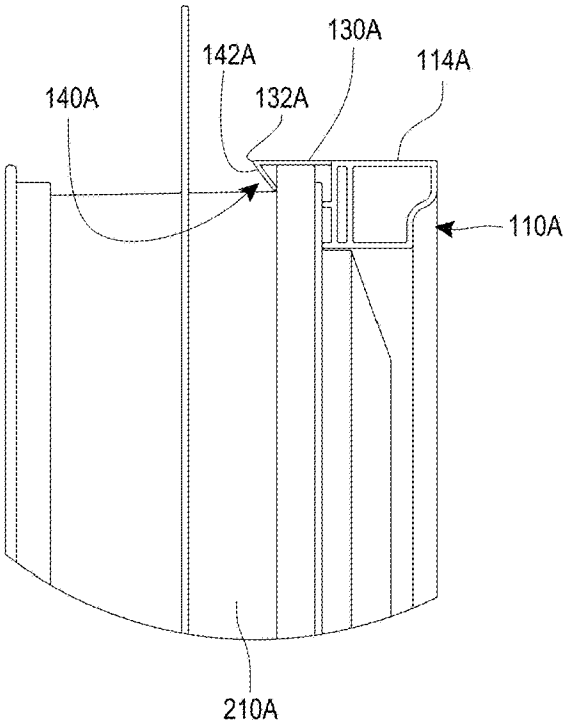
FIG. 9 is a detailed view of a portion of a cross-sectional side view of the window frame and brickmould window trim frame of FIG. 7 assembled together.
Figure 8:
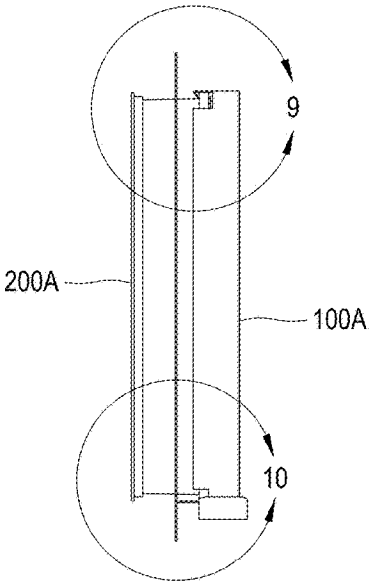
FIG. 8 is a side view of the window frame and brickmould window trim frame of FIG. 7 assembled together.
Figure 11:
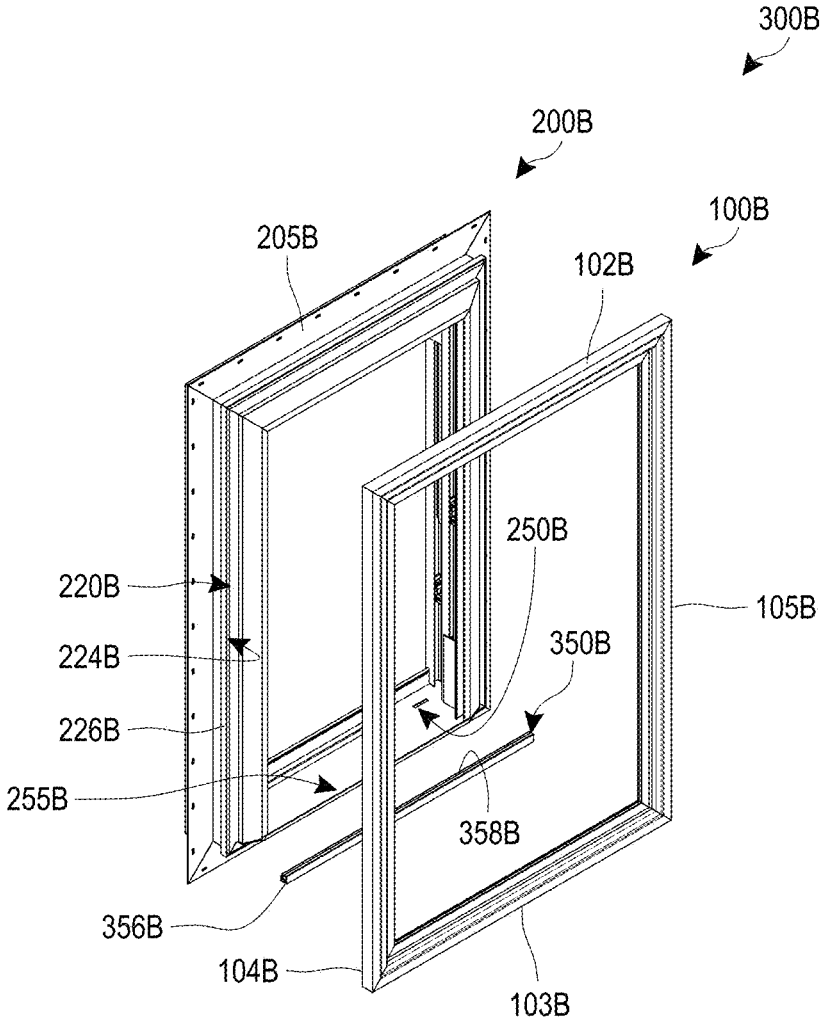
FIG. 11 is a perspective exploded view of a window frame and a brickmould window trim frame.

The brickmould body 110 can have a top surface 112, an outer perimeter surface (e.g., side surface) 114, a bottom surface 116, and an inner perimeter surface 118. The brickmould body 110 is optionally hollow, having a cavity 117 and optionally including one or more reinforcing ribs 119 that extend between at least two surfaces of the brickmould body 110. As shown in FIG. 4, the one or more reinforcing ribs 119 can be a single rib 119 that extends between the top surface 112 and bottom surface 116. However, more than one reinforcing ribs 119 can be provided and can extend between any two surfaces of the brickmould body 110. The one or more reinforcing ribs 119 can provide additional rigidity and strength to the brickmould body 110.

The flange 120 is optionally substantially planar (e.g., flat) and cantilevered relative to the brickmould body 110. The flange 120 has a width W that allows the flange 120 to extend over at least a portion of the ledge 220 and/or window frame 210. Optionally, the flange 120 can help retain the brickmould frame member 102-105 on the window frame assembly 200 as further described below.

The support wall 130 extends from an underside of the flange 120 to a distal edge 132. Optionally, the support wall 130 is generally planar. Optionally, the support wall 130 can flex relative to the flange 120. The support wall 130 extends generally transversely relative to the flange 120 at an angle 150. Optionally, the support wall 130 extends generally perpendicularly relative to the flange 120 (e.g., so that the angle 150 is approximately 90 degrees). In another implementation, the support wall 130 extends at an incline relative to the flange 120 (e.g., inclined away from the brickmould body 110) so that the angle 150 is an acute angle. Such inclined support wall 130 can advantageously facilitate resilient coupling of the trim frame 100 with the window frame assembly 200 and minimize or inhibit rattling of the trim frame 100 relative to the window frame assembly 200. Optionally, the support wall 130 can help retain the brickmould frame member 102-105 on the window frame assembly 200 as further described below.

The hook portion 140 is attached to the support wall 130 and extends from the distal edge 132 of the support wall 130 in a direction away from the brickmould body 110. Optionally, the hook portion 140 extends toward the flange 120. Optionally, the hook portion 140 is defined by an angled wall 142 that extends from the distal end 132 of the support wall 130 to a distal end 144 of the angled wall 142 at an angle 160. Optionally, the angled wall 142 is generally planar. Optionally, the angle 160 is an acute angle. In another implementation, the hook portion 140 can have an L-shape or a C-shape so that the end of the side surface 226 of the ledge portion 220 at least partially extends into the L-shaped or C-shaped opening of the hook portion 140.

The brickmould window trim frame 100 is advantageously installed in the window frame assembly 200 by generally aligning the trim frame 100 over the window frame 210 and pushing the trim frame 100 over the window frame 210 so that the flange 120 is adjacent the top surface 222, so that the support wall 130 is adjacent the side surface 226 and so that the hook portion 140 engages the underside 228 of the ledge portion 220. Optionally, the hook portion 140 snaps or clicks into place against the underside 228 of the ledge portion 220. Optionally, the hook portion 140 provides an audible sound (e.g., click, snap) once the trim frame 100 is completely installed on the window frame 210 (e.g., installed so that the hook portion 140 engages the underside 228 of the ledge portion 220), advantageously providing an indication to the user that a successful installation has been achieved. Once installed, the outer perimeter of the brickmould body 110 of the trim frame 100 can be caulked against the wall to prevent water seepage under the brickmould trim frame 100. Additionally, the flange 120 can be caulked against the top surface 222 of the ledge portion 220 to inhibit water seeping under the flange 120 (e.g., caulk is applied over the groove 224).

Advantageously, the brickmould window trim frame 100 is self-retaining on the window frame assembly 200. For example, one or more of the flange 120, support wall 130 and hook portion 140 of one or more of the frame members 102-105 retain the trim wall 100 on the window frame assembly 200 without the need of fasteners (e.g., screws, nails, adhesive, etc.) to retain the trim frame 100 on the window frame assembly 200. Optionally, the trim frame 100 remains securely attached to the window frame assembly 200 even if one of the hook portions 140 fails (e.g., breaks, does not properly catch onto the underside 228 of the ledge portion 220).

Advantageously, the brickmould window trim frame 100 is self-centering on the window frame assembly 200. For example, the independent flexing of the support wall 130 and/or hook portion 140 of one or more of the frame members 102-105 allows each to exert a force on the ledge portion 220 over which it's placed, urging the trim frame 100 to a centered position over the window frame assembly 200. Optionally, the support wall 130 extending at an incline relative to the flange 120, as discussed above, further facilitates the self-centering of the trim frame 100 on the window frame assembly 200.

Advantageously, the brickmould window trim frame 100 is easy to install. For example, installation can be done by hand, does not require the use of tools, and can be performed by a single individual, therefore significantly reducing the time and labor for providing a brickmould trim as part of a window installation. Such reduction in time and labor can allow the window installer to complete the window installation project much faster than with conventional brickmould trim (e.g., complete the installation in about 5-10 minutes rather than 2 hours), allowing the installer to complete more jobs per day using the brickmould window trim frame 100. Additionally, the ease of installing the trim frame 100 advantageously allows a lower skilled worker to install it, freeing up a higher skilled worker for other work.

The brickmould window trim frame 100 can come in a variety of profiles, shapes and widths. In one implementation, the bottom frame portion 103 defines a window sill when the trim frame 100 is coupled to the window frame assembly 200. In another implementation the left and right side frame members 104-105 can define shutters (e.g., ornamental shutters) on either side of the window frame assembly 200. In one implementation, the trim frame 100 can be applied to the interior side (e.g., room facing side) of the window frame assembly 200 as well to the exterior side (e.g., outdoor facing side) of the window frame assembly 200.

FIGS. 7-10 show a brickmould window trim frame 100A that can be installed on a window frame 200A, as discussed further below, to provide a window assembly 300A with a brickmould trim. Some of the features of the brickmould window trim frame 100A and window frame 200A are similar to features in the brickmould window trim frame 100 and window frame 200 in FIGS. 1-6. Thus, references numerals used to designate the various components of the brickmould window trim frame 100A and the window frame 200A are identical to those used for identifying the corresponding components of the brickmould window trim frame 100 and window frame 200 in FIGS. 1-6, except that an "A" is added to the numerical identifier. Therefore, the structure and description for the various components of the window frame 200 and brickmould window trim frame 100 in FIGS. 1-6 are understood to also apply to the corresponding components of the window frame 200A and brickmould window trim frame 100A in FIG. 7-10, except as described below.

The window frame 200A can optionally be identical to the window frame 200. The brickmould window trim frame 100A has a top frame member 102A, a left-side frame member 104A and a right-side frame member 105A attached together (e.g., welded together) to define a single piece (e.g., a monolithic, integral) frame. Unlike the brickmould window trim frame 100, the trim frame 100A does not have a bottom frame member attached to the left and right-side frame members 104A-105A. Rather, a flushmount member 400A is removably attached to the trim frame 100A as discussed further below.

Each of the top, left-side and right-side frame members 102A, 104A, 105A can have a body 110A that contacts the top surface 222A of the window frame 200A, and an outer perimeter surface (e.g., side surface) 114A that generally aligns with (e.g., is coplanar with) the support wall 130A so that the outer perimeter surface (e.g., side surface 114A) does not significantly add to the outer perimeter profile of the window frame 100A (e.g., add to the outer perimeter dimension of the ledge portion 220A). A hook portion 140A (e.g., an angled wall 142A) is attached to the support wall 130A and extends from the distal edge 132A of the support wall 130A in a direction toward the brickmould body 110A.

The trim frame 100A can be installed on the window frame 200A in a similar manner as described above for the trim frame 100, for example, by generally aligning the trim frame 100A over the window frame 210A and pushing the trim frame 100A over the window frame 200A so that the body 110A is adjacent the front surface 222A, so that the support wall 130A is adjacent the side surface 226A and so that the hook portion 140A engages the underside 228A of the ledge portion 220A. Optionally, the hook portion 140A snaps or clicks into place against the underside 228A of the ledge portion 220A (e.g., providing an audible sound).

The flushmount member 400A includes a body 410A, a flex spring (e.g. snap leg) 420A that extends from a rear surface of the body 410A, and a shroud wall 430A that extends from a rear surface of the body 410A. Once the trim frame 100A is installed on the window frame 200A, as discussed above, the flushmount member 400A is coupled to the window frame 200A by inserting the flex spring (e.g., snap leg) 420A into the groove 224A (e.g., accessory groove) on the front surface 222A of the window frame 200A and so that the shroud wall 430A substantially extends toward (e.g., extends to) the nail fin 205A. The body 410A of the flushmount member 400A can then be fastened to the trim frame 100A (e.g., to the left-side and right-side frame members 104A-105A), such as with one or more screws 435A, to draw the trim frame 100A down onto the body 410A. Optional end caps 440A cover the ends of the body 410A.

Advantageously, the trim frame 100A and flushmount member 400A make the field and factory installation on a window frame 200A easier by allowing an amount of play (e.g., ¼ inches) in the trim frame 100A relative to the window frame 200A (e.g., allowing the trim frame 100A to float relative to the window frame 200A) until the flushmount member 400A is coupled to the trim frame 100A to decrease the play and provide the desired fit around the window frame 200A. As with the trim fame 100, the trim frame 100A and flushmount member 400A significantly reduce the installation time on a window frame 200A to provide a brickmould trim (e.g., reduces installation time from 2 hours or more to about 10 minutes or less). Additionally, this assembly reduces the possibility that the flushmount 400A and trim frame 100A will be damaged during installation.

FIGS. 11-14 show a brickmould window trim frame 100B that can be installed on a window frame 200B, as discussed further below, to provide a window assembly 300B with a brickmould trim. Some of the features of the brickmould window trim frame 100B and window frame 200B are similar to features in the brickmould window trim frame 100 and window frame 200 in FIGS. 1-6. Thus, references numerals used to designate the various components of the brickmould window trim frame 100B and the window frame 200B are identical to those used for identifying the corresponding components of the brickmould window trim frame 100 and window frame 200 in FIGS. 1-6, except that a "B" is added to the numerical identifier. Therefore, the structure and description for the various components of the window frame 200 and brickmould window trim frame 100 in FIGS. 1-6 are understood to also apply to the corresponding components of the window frame 200B and brickmould window trim frame 100B in FIG. 11-14, except as described below.

The window frame 200B is for an operating window (e.g., double-hung window assembly). The window frame 200B includes a weep hole 250B on a base 255B of the window frame 200B via which moisture is removed. The weep hole 250B fluidly communicates with a channel 252B in the frame 200B that directs the moisture to an opening on the outer surface 222B of the frame 200B.

The brickmould window trim frame 100B can substantially have the same structure and components as the brickmould window trim frame 100 discussed above in connection with FIGS. 1-6, and can be installed on the window frame 200B in generally the same manner as the trim frame 100 is installed on the window frame 200, except as described below.

As shown in FIGS. 11-14, an adapter block (e.g., a spacer block) 350B is provided that has a length substantially the same as a length of the ledge 220B. Optionally, the spacer block 350B can have substantially the same thickness as the ledge 220B (e.g., so that a surface 356B of the spacer block 350B substantially coincides, in width or depth, with the side surface 226B of the ledge 220B). The spacer block 350B can have a flex spring or snap leg 358B that can be inserted into the accessory groove 224B of the window frame 200B to couple the spacer block 350B to the ledge 220B. Once the spacer block 350B is coupled to the window frame 200B via the accessory groove 224B, the trim frame 100B can be coupled to the window frame 200B so that the hook portions 140B extend over the ledge portion 220B on three sides of the window frame 200B and over the spacer block 350B on the remaining side of the window frame 200B. The spacer block 350B advantageously causes the trim frame 100B to couple to the window frame 200B in a way that does not block the opening on the surface 222B of the frame 200B through which moisture from the weep hole flows. The spacer block 350B shifts the location of the trim frame 100B to advantageously allow the weeping function of the window frame 200B.

Figure 19:
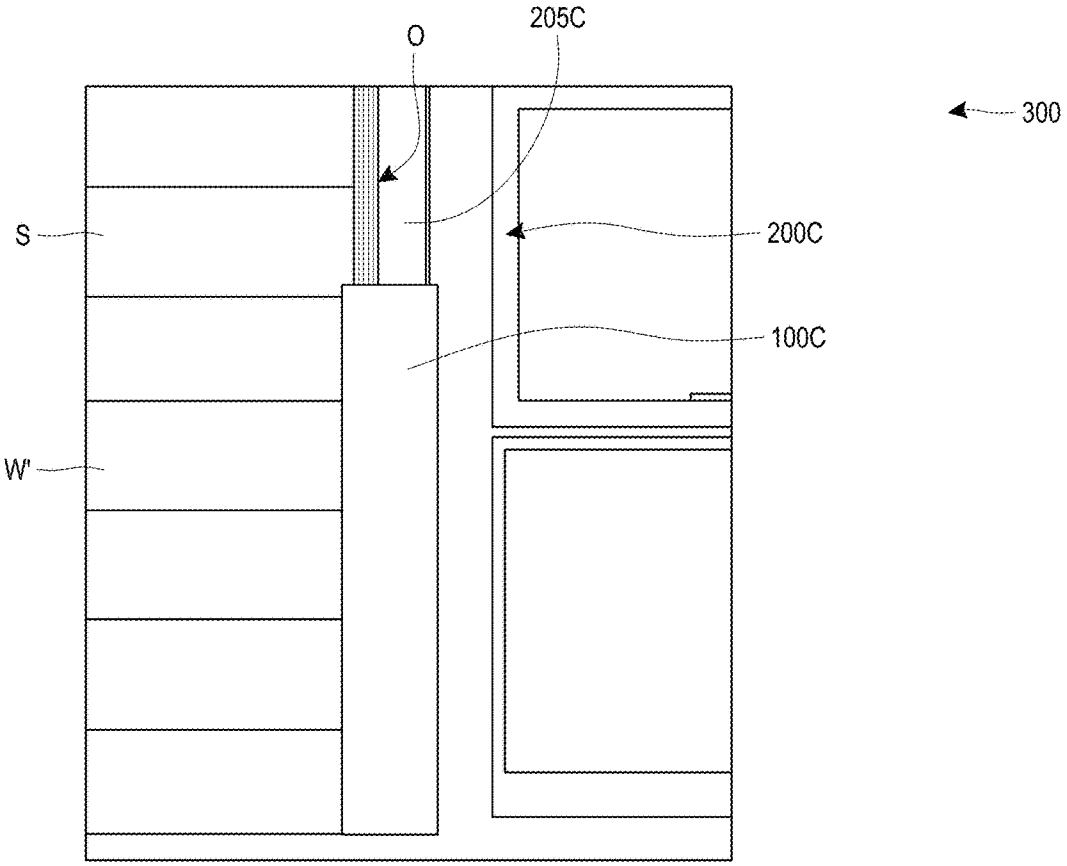
FIG. 19 is a front view of the window frame and a portion of the brickmould window trim frame of FIG. 15 installed on an outer house wall.
Figure 20:
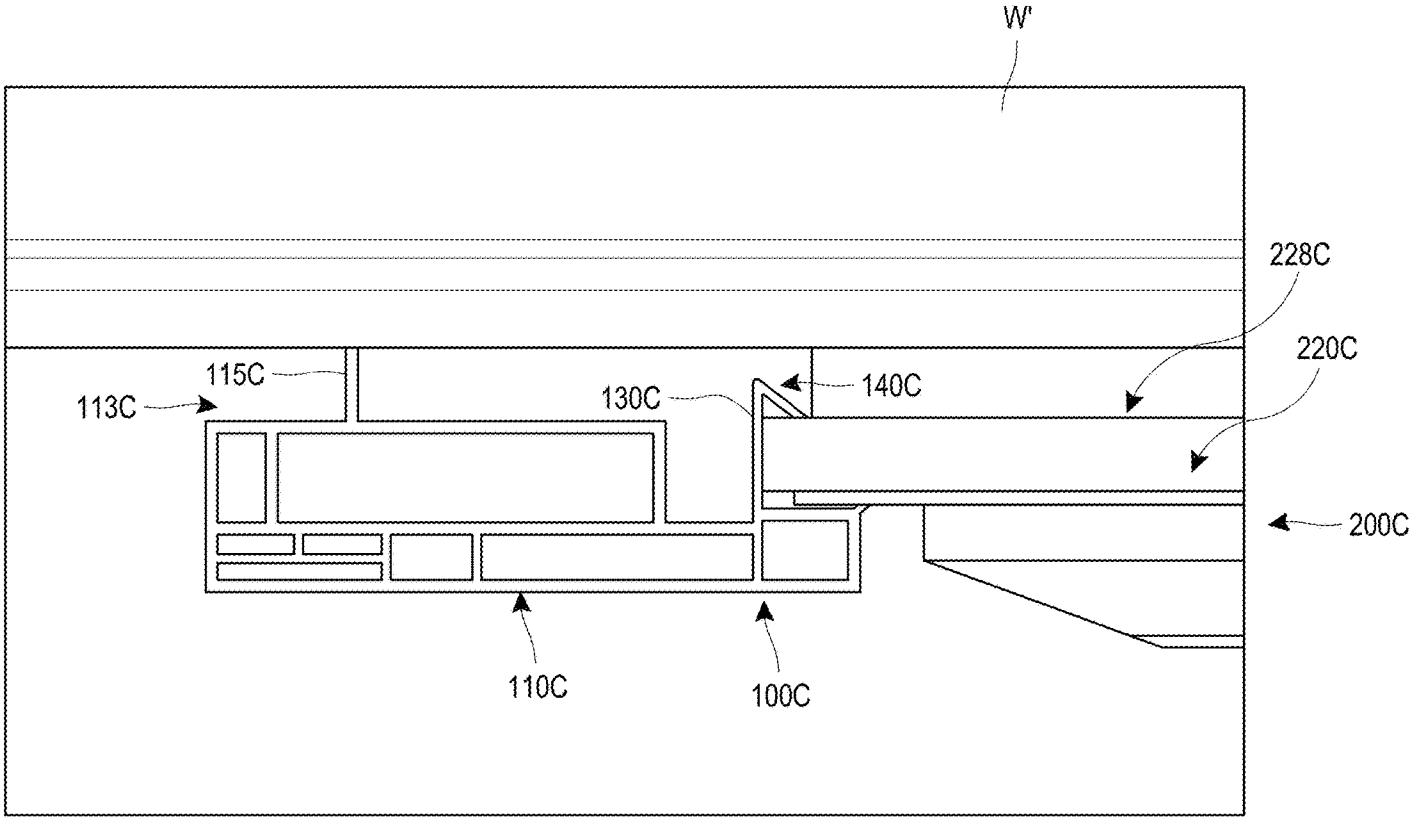
FIG. 20 is a sectional top view of the window frame and brickmould window trim frame of FIG. 15 installed on an outer house wall.
Figure 21:
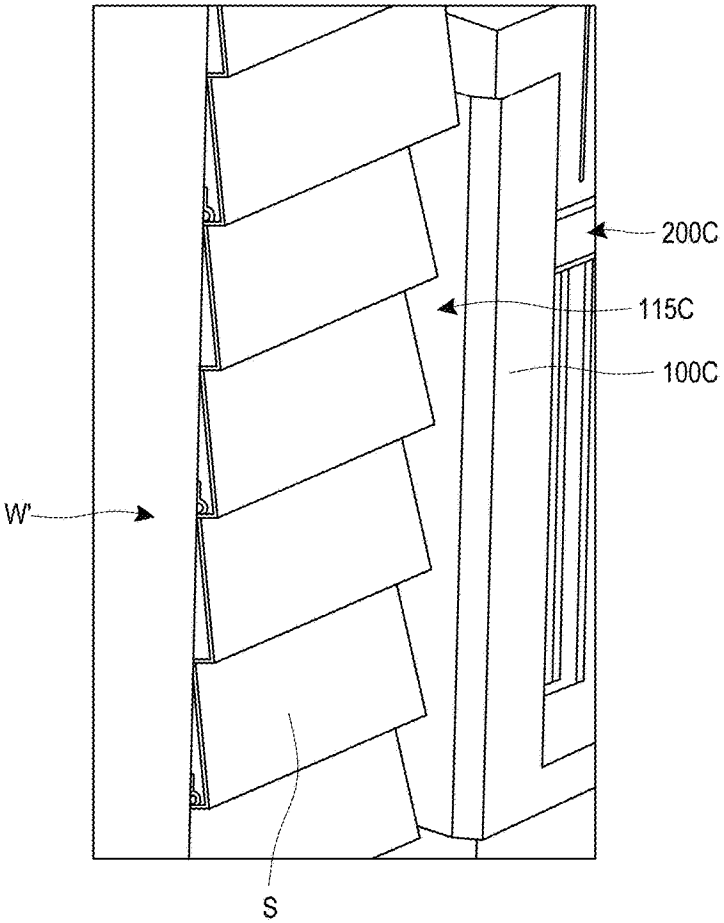
FIG. 21 is an angled side view of the window frame and a portion of the brickmould window trim frame of FIG. 15 installed on an outer house wall.

FIGS. 15-21 show a brickmould window trim frame 100C that can be installed on a window frame 200C, as discussed further below, to provide a window assembly 300C with a brickmould trim. Some of the features of the brickmould window trim frame 100C and window frame 200C are similar to features in the brickmould window trim frame 100B and window frame 200B in FIGS. 11-14. Thus, references numerals used to designate the various components of the brickmould window trim frame 100C and the window frame 200C are identical to those used for identifying the corresponding components of the brickmould window trim frame 100B and window frame 200B in FIGS. 11-14, except that a "C" is added to the numerical identifier. Therefore, the structure and description for the various components of the window frame 200B and brickmould window trim frame 100B in FIGS. 11-14 are understood to also apply to the corresponding components of the window frame 200C and brickmould window trim frame 100C in FIG. 15-21, except as described below. FIGS. 19-21 only show a portion of the trim frame 100C coupled to the window frame 200C to allow view of the features (e.g., nail fin 205C) disposed under the trim frame 100C. However, one of skill in the art will recognize that the trim frame 100C (once installed) will extend around the window frame 200C as show in FIG. 15.

The window frame 200C is optionally identical to the window frame 200B (e.g., a window frame for an operating window, such as a double-hung window assembly). The brickmould window trim frame 100C differs from the brickmould window trim frame 100B in that it is for use in a full tear out of a window.

The brickmould window trim frame 100C has a body 110C, a flange 120C, a support wall 130C and a hook portion 140C that are similar to those in the brickmould window trim frame 100B. The outer perimeter surface (e.g., side surface) 114C extends past the edge of the nail fin 205C when the trim frame 100C is coupled to the window frame 200C. The trim frame 100C also has a leg (or wall) 115C that extends from an underside of the body 110C toward (a plane of) the nail fin 205C to cover the space between the body 110C and the nail fin 205C. The leg (or wall) 115C can optionally extend along the perimeter (e.g., the entire perimeter) of the trim frame 100C. The leg (or wall) 115C is spaced inward from the outer perimeter surface 114C so as to define a slot or cavity 113C under the body 110C between the outer perimeter surface 114C and the leg (or wall) 115C. The trim frame 100C is installed on the window frame 200C after a spacer block 350C is attached to the window frame 200C (e.g., coupled to the accessory groove 224C), in a similar way as discussed above for the window frame 200B.

The use of the brickmould window trim frame 100C advantageously allows the finishing of a window installation (e.g., by snapping on the trim frame 100C on the window frame 200C) where a previous window has been fully torn out and removed (e.g., on a house with siding on the outer walls of the house). Usually in such full window tear outs, the siding S has to either be removed completely to access and remove the prior window, or the siding S is cut at a distance just past the edge of the nail fin 205C (see FIG. 19), to thereby allow access to the nails or screws on the nail fin 205C and removal of the existing window frame. Such cutting of the siding panels S creates a gap or opening O between the window frame 200C and the siding panels S. Installation of the trim frame 100C around the newly replaced window frame 200C on the wall W', allows the covering of the opening O so that it is not visible. Further, the leg (or wall) 115C extends into the opening O, as shown in FIGS. 20-21, thereby blocking a side view of the opening O (e.g., blocking a side view of any flashing or caulking done in that space). Further, the leg (or wall) 115C allows the end of the siding panels S to extend into the slot or cavity 113C as shown in FIG. 21, thereby providing a clean finish to the replacement window and covering the opening O.

FIGS. 22-25 show a brickmould window trim frame 100D that can be installed on a window frame 200D, as discussed further below, to provide a window assembly 300D with a brickmould trim. Some of the features of the brickmould window trim frame 100D and window frame 200D are similar to features in the brickmould window trim frame 100B and window frame 200B in FIGS. 11-14. Thus, references numerals used to designate the various components of the brickmould window trim frame 100D and the window frame 200D are identical to those used for identifying the corresponding components of the brickmould window trim frame 100B and window frame 200B in FIGS. 11-14, except that a "D" is added to the numerical identifier. Therefore, the structure and description for the various components of the window frame 200B and brickmould window trim frame 100B in FIGS. 11-14 are understood to also apply to the corresponding components of the window frame 200D and brickmould window trim frame 100D in FIG. 22-25, except as described below.

The window frame 200D has an accessory groove 224D on one or more sides (e.g., on all sides) of the window frame 200D and side walls 230D. In the illustrated implementation, the side walls 230D do not have ledge portions (e.g., such as ledge portion 220B in FIG. 11) to which the brickmould window trim frame 100D can couple, nor has a nail fin (e.g., similar to nail fin 205B in FIG. 11). To allow coupling of the brickmould window trim frame 100D to the window frame 200D, adapter blocks 351D, 352D, 353D, 354D are provided that can couple to the accessory groove 224D as described further below.

Figure 22:
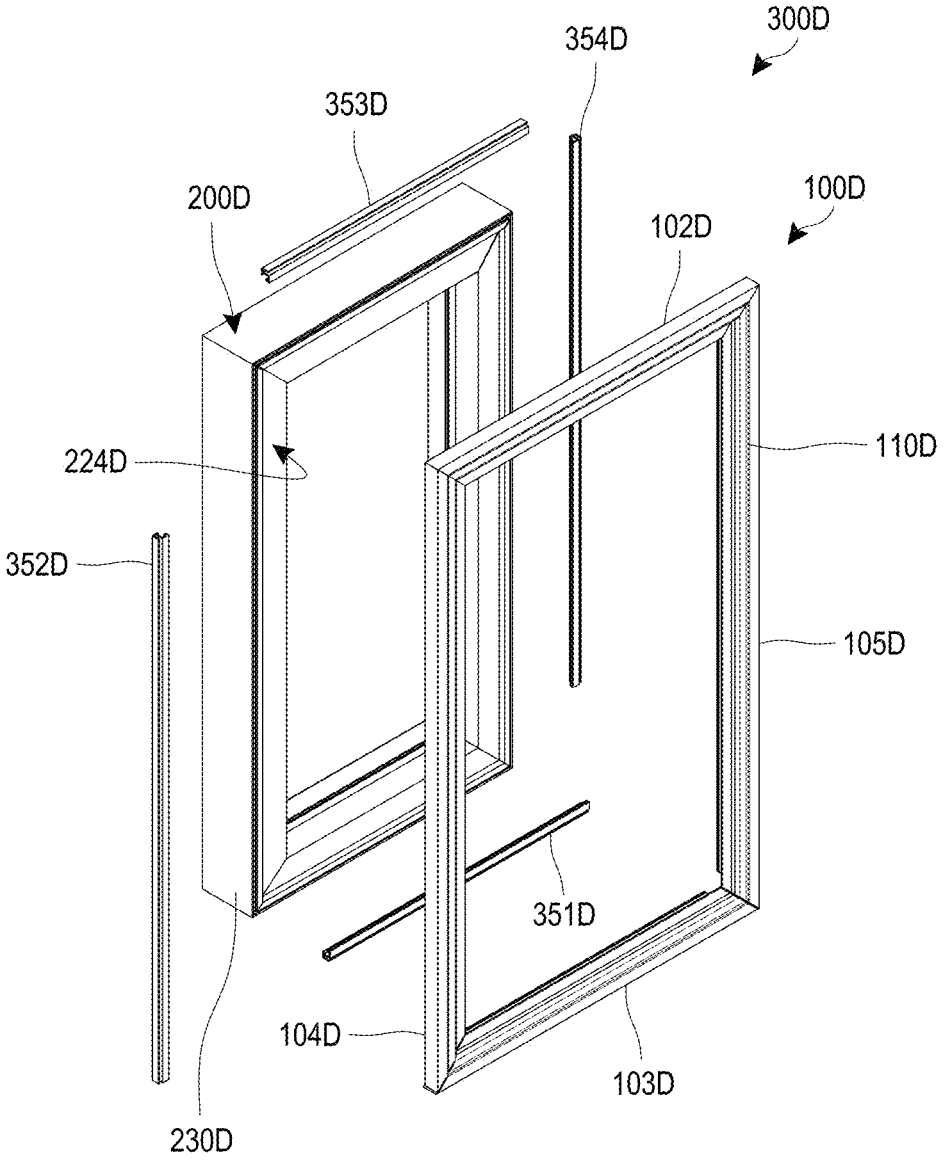
FIG. 22 is a perspective exploded view of a window frame and a brickmould window trim frame.
Figure 22A:
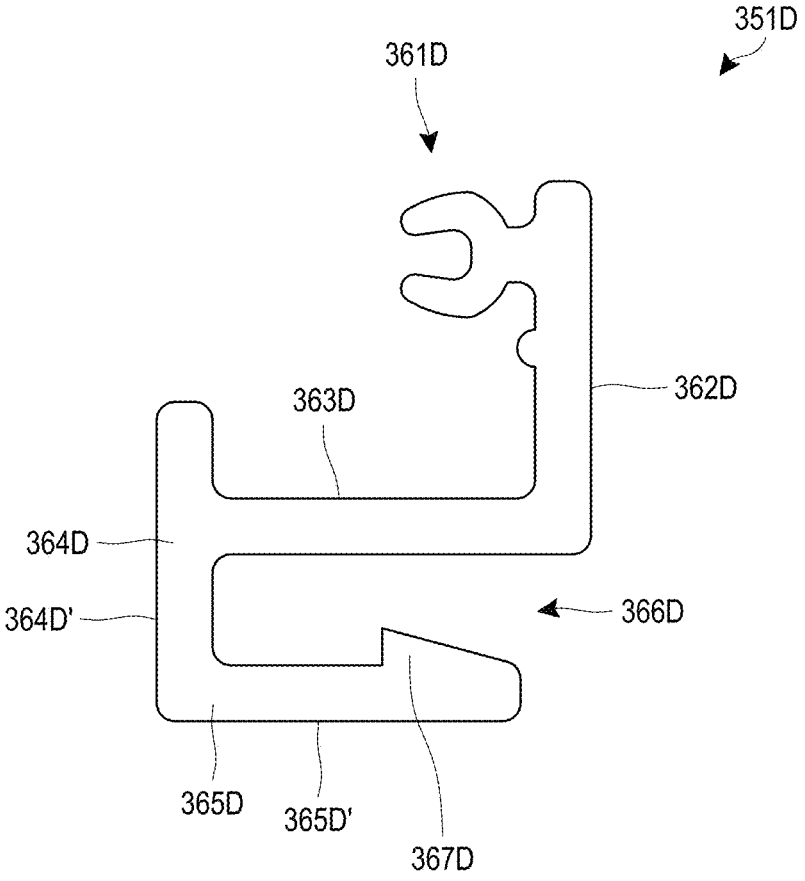
FIG. 22A is an end view of an adapter block for use with the window frame of FIG. 22.
Figure 25:
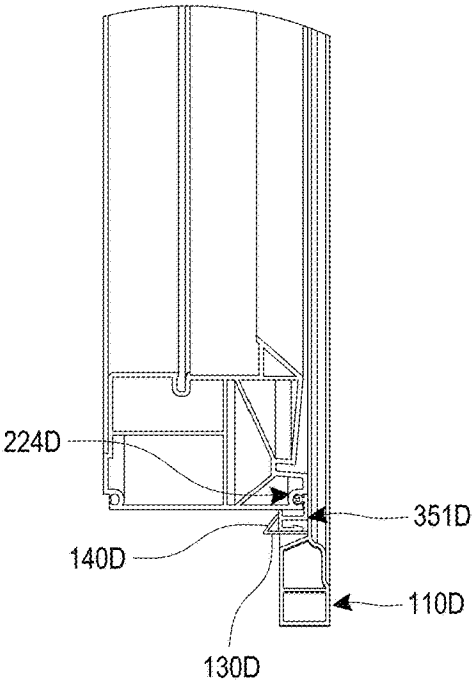
FIG. 25 is a detailed view of another portion of the cross-sectional side view of the window trim frame and brickmould window trim frame of FIG. 22 assembled together.
Figure 24:
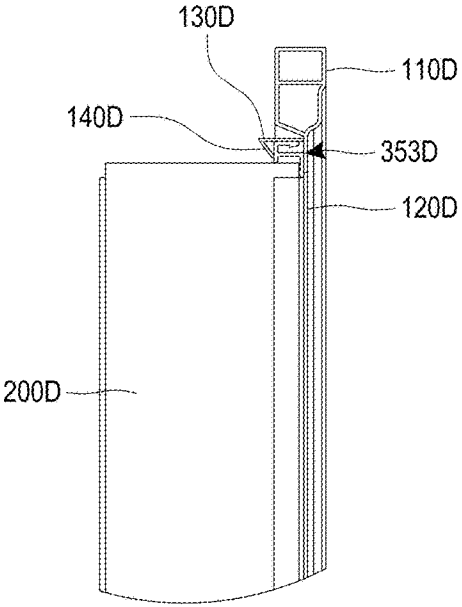
FIG. 24 is a detailed view of a portion of a cross-sectional side view of the window frame and brickmould window trim frame of FIG. 22 assembled together.
Figure 23:
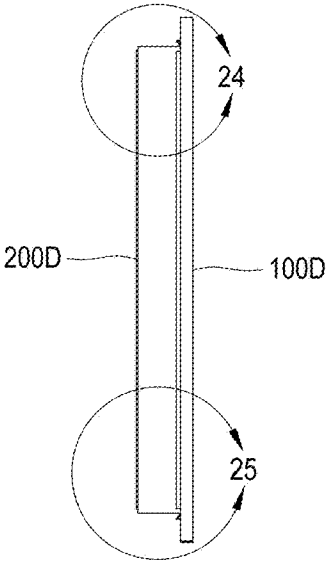
FIG. 23 is a side view of the window frame and brickmould window trim frame of FIG. 22 assembled together.
Figure 26:
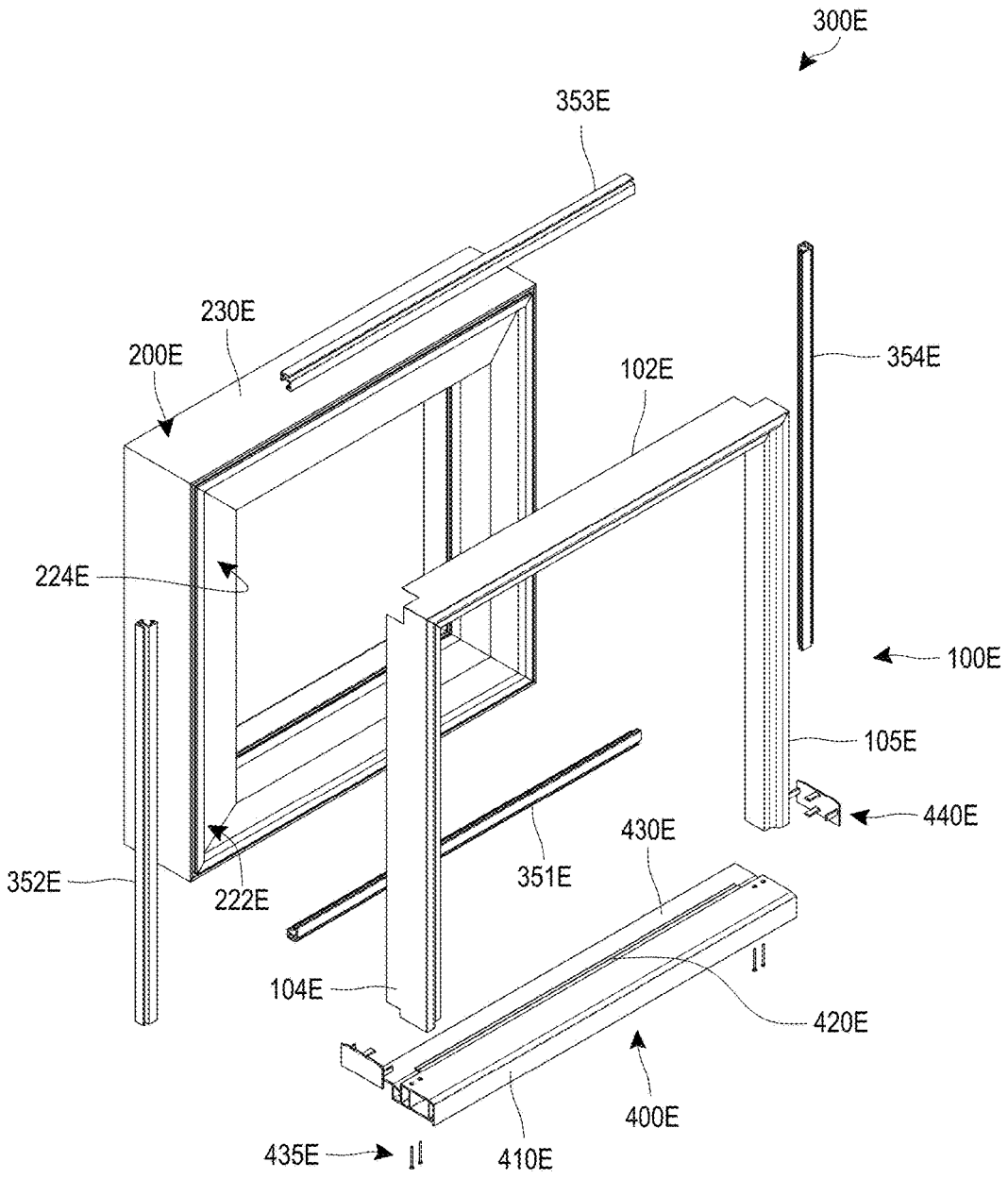
FIG. 26 is a perspective exploded view of a window frame and a brickmould window trim frame.
Figure 29:
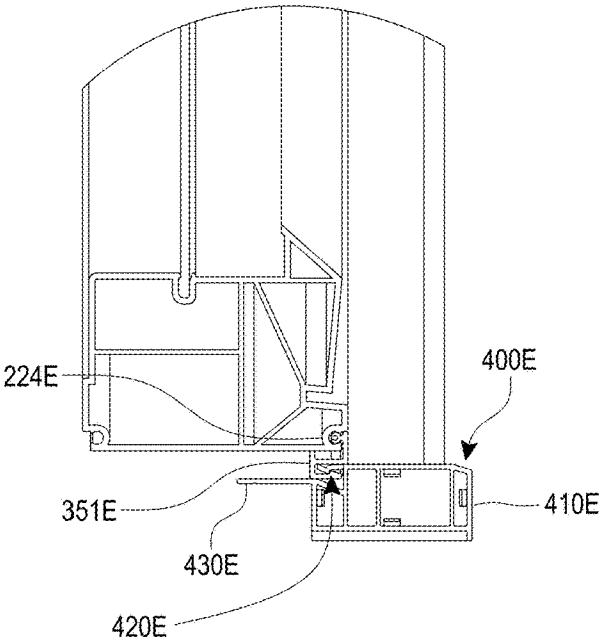
FIG. 29 is a detailed view of another portion of the cross-sectional side view of the window trim frame and brickmould window trim frame of FIG. 26 assembled together.
Figure 28:
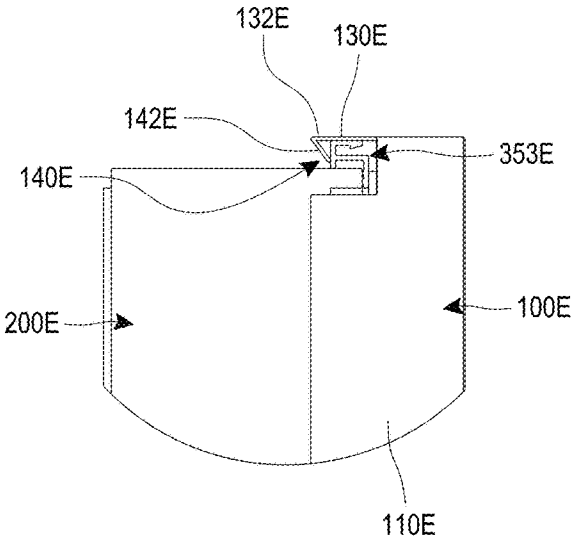
FIG. 28 is a detailed view of a portion of a cross-sectional side view of the window frame and brickmould window trim frame of FIG. 26 assembled together.
Figure 27:
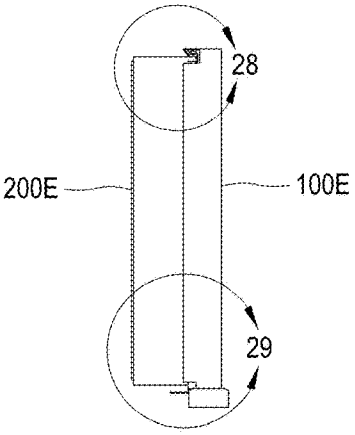
FIG. 27 is a side view of the window frame and brickmould window trim frame of FIG. 26 assembled together.

FIG. 22A shows an end view of an adapter block 351D. The adapter blocks 352D-354D can optionally have the same profile (e.g., an identical profile) as the adapter block 351D but can optionally vary in one or more features between each other (e.g., vary in length to correspond to the different side lengths of the window frame 200D). The adapter block 351D has a protrusion 361D that can be inserted into the accessory groove 224D to couple the adapter block 351D to the window frame 200D. A first wall member 362D can extend between the protrusion 361D and a second member 363D, where the second member 363D extends generally perpendicular to the first member 362D. The second member 363D can extend from the first member 362D to a third member 364D that extends generally perpendicular to the second member 363D (e.g., so that the third member 364D and first member 362D are generally parallel). The third member 364D can have a side surface 364D' and extend from the second member 363D to a fourth member 365D that extends generally perpendicular to the third member 364D. The fourth member 365D can have a side surface 365D' and extend generally parallel to the second member 363D to define a slot 366D therebetween. The fourth member 365D can have a prong 367D that can securely receive a snap feature in the slot 366D as discussed further below.

The brickmould window trim frame 100D has a body 110D, a flange 120D, a support wall 130D and a hook portion 140D that are similar to those in the brickmould window trim frame 100B. The trim frame 100D is installed on the window frame 200D after the adapter blocks 351D-354D are attached to the window frame 200D (e.g., coupled to the accessory groove 224D), allowing the hook portion 140D of the trim frame 100D to engage the side surface 364D' of the third member 364D of the adapter blocks 351D-354D and the support wall 130D to extend adjacent side surface 365D' of the fourth member 365D of the adapter blocks 351D-354D.

Advantageously, the adapter blocks 351D-354D allow the trim frame 100D to be used with a window frame 200D that does not already have a ledge portion (such as ledge portion 220B in FIG. 11) to which the hook portions 140D of the trim frame 100D can readily couple. Accordingly, the adapter blocks 351D-354D allow the application of the brickmould trim frame 100D to be used with a different window frame than those previously discussed, increasing the applicability of the trim frame 100D.

FIGS. 26-29 show a brickmould window trim frame 100E that can be installed on a window frame 200E, as discussed further below, to provide a window assembly 300E with a brickmould trim. Some of the features of the brickmould window trim frame 100E and window frame 200E are similar to features in the brickmould window trim frame 100A, 100B and window frame 200A, 200B in FIGS. 7-14. Thus, references numerals used to designate the various components of the brickmould window trim frame 100E and the window frame 200E are identical to those used for identifying the corresponding components of the brickmould window trim frame 100A,100B and window frame 200A, 200B in FIGS. 7-14, except that an "E" is added to the numerical identifier. Therefore, the structure and description for the various components of the window frame 200A, 200B and brickmould window trim frame 100A, 100B in FIGS. 7-14 are understood to also apply to the corresponding components of the window frame 200E and brickmould window trim frame 100E in FIG. 22-25, except as described below.

The window frame 200E has an accessory groove 224E on one or more sides (e.g., on all sides) of the window frame 200E and side walls 230E. In the illustrated implementation, the side walls 230E do not have ledge portions (e.g., such as ledge portion 220B in FIG. 11) to which the brickmould window trim frame 100E can couple, nor has a nail fin (e.g., similar to nail fin 205B in FIG. 11). To allow coupling of the brickmould window trim frame 100E to the window frame 200E, adapter blocks 351E, 352E, 353E, 354E are provided that can couple to the accessory groove 224E as described further below. One or more (e.g., each) of the adapter blocks 351E, 352E, 353E, 354E can have the same shape and features as (e.g., be identical to) the adapter blocks 351D-354D in FIG. 22A. Unlike the brickmould window trim frame 100B, the trim frame 100E does not have a bottom frame member attached to the left and right-side frame members 104E-105E. Rather, a flushmount member 400E is removably attached to the trim frame 100E as discussed further below Each of the top, left-side and right-side frame members 102E, 104E, 105E can have a body 110E that contacts the top surface 222E of the window frame 200E, and an outer perimeter surface (e.g., side surface) 114E that generally aligns with (e.g., is coplanar with) the support wall 130E so that the outer perimeter surface (e.g., side surface 114E) does not significantly add to the outer perimeter profile of the window frame 100E. A hook portion 140E (e.g., an angled wall 142E) is attached to the support wall 130E and extends from the distal edge 132E of the support wall 130E in a direction toward the brickmould body 110E.

The trim frame 100E can be installed on the window frame 200E in a similar manner as described above for the trim frame 100A, for example, by generally aligning the trim frame 100E over the window frame 200E and pushing the trim frame 100E over the window frame 200E so that the body 110E is adjacent the front surface 222E, so that the support wall 130E is adjacent the side surface 230E and so that the hook portion 140E engages a surface of the adapter blocks 352E, 353E, 354E (e.g., engages surface 365D' of the fourth member 365D, where the adapter blocks 352E-354E are identical to the adapter blocks 352D-354D). Optionally, the hook portion 140E snaps or clicks into place against the adapter block 352E-354E (e.g., providing an audible sound).

The flushmount member 400E includes a body 410E, a flex spring (e.g. snap leg) 420E that extends from a rear surface of the body 410E, and a shroud wall 430E that extends from a rear surface of the body 410E. Once the trim frame 100E is installed on the window frame 200E, as discussed above, the flushmount member 400E is coupled to the window frame 200E by inserting the flex spring (e.g., snap leg) 420E into the slot in the adapter block 351E (e.g., into the slot 366D in adapter block 351D to engage the prong 367D, if the adapter block 351E is identical to adapter block 351D), and so that the shroud wall 430E extends at least partially over the side surface 230E. The body 410E of the flushmount member 400E can then be fastened to the trim frame 100E (e.g., to the left-side and right-side frame members 104E-105E), such as with one or more screws 435E, to draw the trim frame 100E down onto the body 410E. Optional end caps 440E cover the ends of the body 410E.

Advantageously, the trim frame 100E and flushmount member 400E make the field and factory installation on a window frame 200E easier by allowing an amount of play (e.g., ¼ inches) in the trim frame 100E relative to the window frame 200E (e.g., allowing the trim frame 100E to float relative to the window frame 200E) until the flushmount member 400E is coupled to the trim frame 100E to decrease the play and provide the desired fit around the window frame 200E. As with the trim fame 100A, the trim frame 100E and flushmount member 400E significantly reduce the installation time on a window frame 200E to provide a brickmould trim (e.g., reduces installation time from 2 hours or more to about 10 minutes or less). Additionally, this assembly reduces the possibility that the flushmount 400E and trim frame 100E will be damaged during installation.

Advantageously, the adapter blocks 351E-354E allow the trim frame 100E to be used with a window frame 200E that does not already have a ledge portion (such as ledge portion 220B in FIG. 11) to which the hook portions 140E of the trim frame 100E can readily couple. Further, the adapter blocks 351E-354E allow the trim frame 100E to be used with a flushmount member 400E, as discussed above. Accordingly, the adapter blocks 351E-354E allow the application of the brickmould trim frame 100E to be used with a different window frame than those previously discussed, increasing the applicability of the trim frame 100E.

Figure 14:
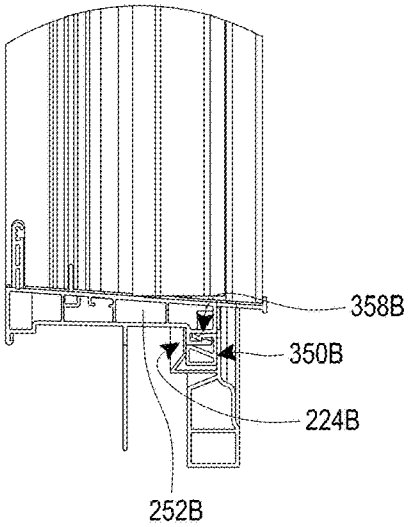
FIG. 14 is a detailed view of another portion of the cross-sectional side view of the window frame and brickmould window trim frame of FIG. 11 assembled together.
Figure 13:
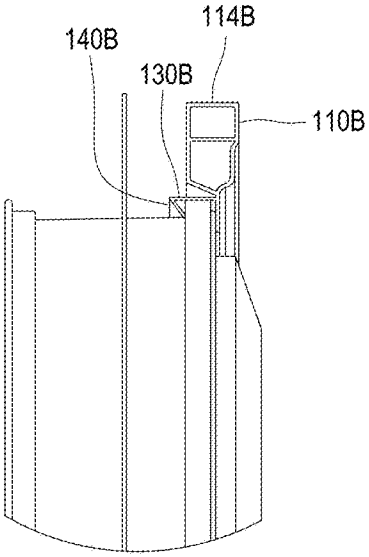
FIG. 13 is a detailed view of a portion of a cross-sectional side view of the window frame and brickmould window trim frame of FIG. 11 assembled together.
Figure 12:
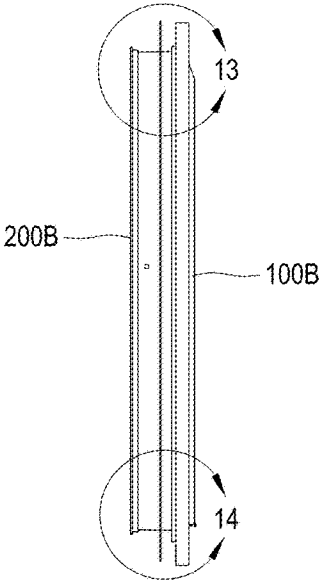
FIG. 12 is a side view of the window frame and brickmould window trim frame of FIG. 11 assembled together.
Figure 15:
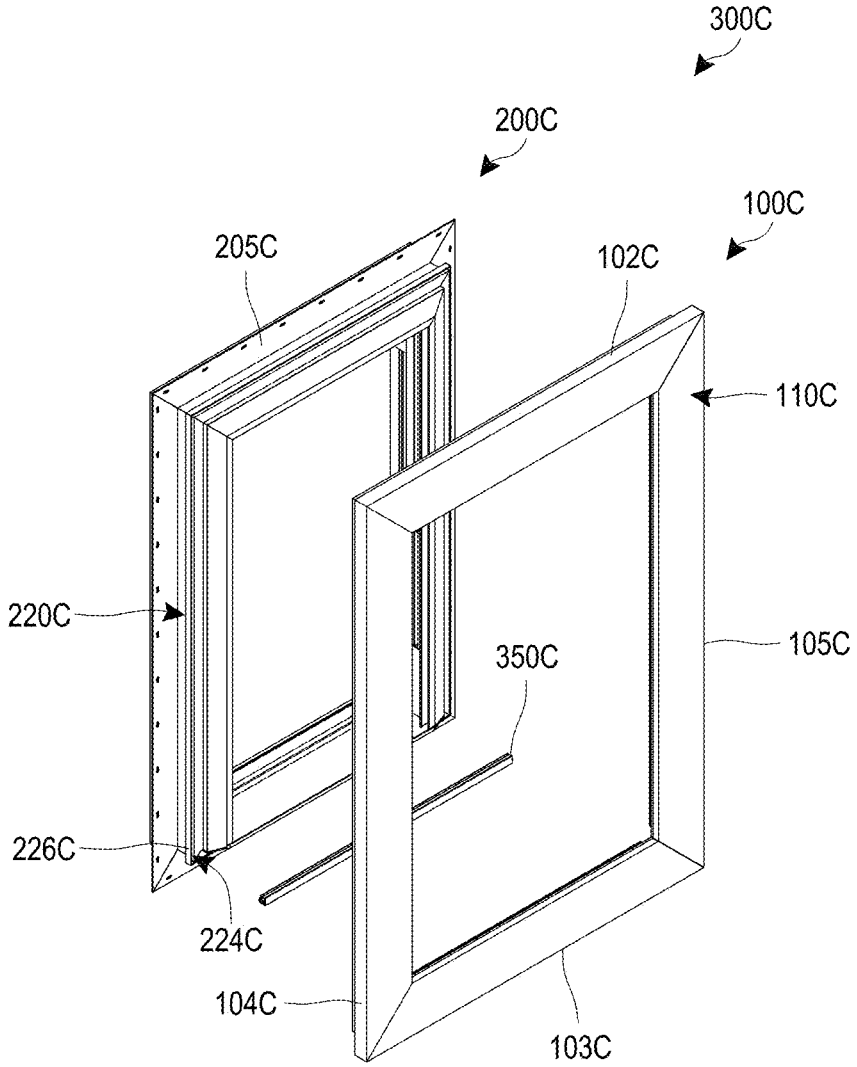
FIG. 15 is a perspective exploded view of a window frame and a brickmould window trim frame.
Figure 18:
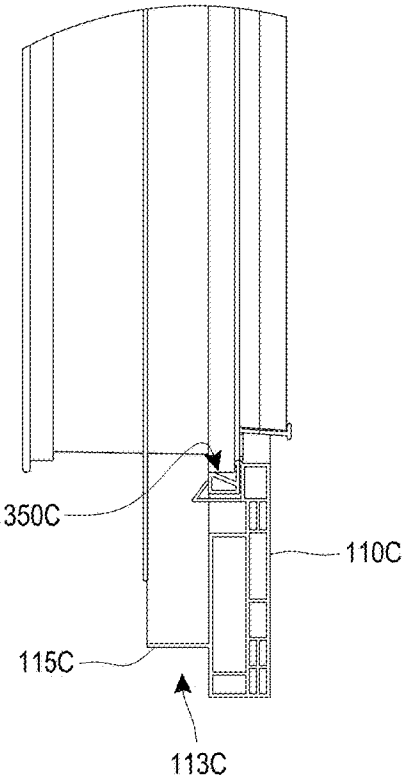
FIG. 18 is a detailed view of another portion of the cross-sectional side view of the window frame and brickmould window trim frame of FIG. 15 assembled together.
Figure 17:
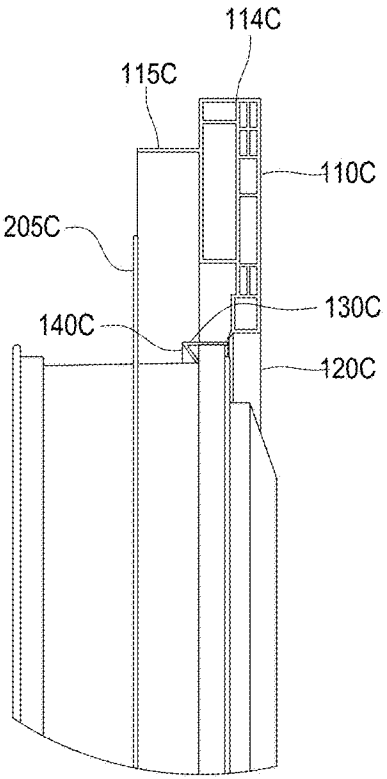
FIG. 17 is a detailed view of a portion of a cross-sectional side view of the window frame and brickmould window trim frame of FIG. 15 assembled together.
Figure 16:
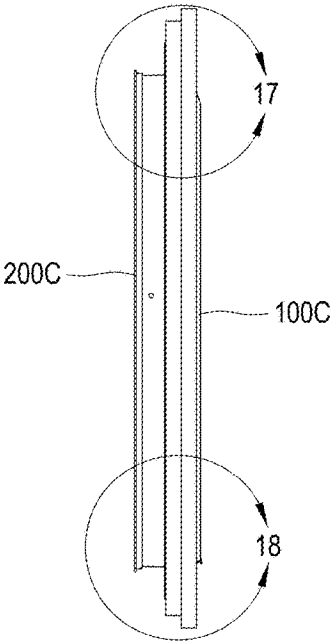
FIG. 16 is a side view of the window frame and brickmould window trim frame of FIG. 15 assembled together.

The use of the brickmould window trim frame 100, 100A-E advantageously allows the window replacement process to occur faster, reducing labor time and cost, thereby allowing a window installer to complete more window installations in any given period of time (e.g., per day). As discussed previously, once the window frame 200, 200A-E has been installed on the home, the brickmould window trim frame 100, 100A-E is easily installed by snapping (e.g., clipping) the trim frame 100, 100A-E over the window frame 200, 200A-E (e.g., so that the hook portions 140, 140A-E engage the ledge portion 220, 220A-C of the window frame 200, 200A-C, or engage an adapter block 351D-354D, 351E-354E attached to the window frame 200D-E) as discussed previously. Further, where the window frame 200B-C has a weep hole or channel as shown in FIG. 14 or 17, or where the window frame 200D-E does not have a ledge portion (e.g., ledge portion 220A-C), a spacer or adapter block 350B-C, 351D-354D, 351E-354E can be attached to the window frame 200B-E (e.g., coupled to the accessory groove 224B-E), for example so that installation of the trim frame 100B-C does not block the weep channel (e.g., the hook portion 140B-C of the end of the trim frame 100B-C where the spacer block 350B-C is installed engages the underside of the spacer block 350B-C instead of the underside of the ledge portion 220B-C).

Advantageously, one or more of the brickmould window trim frames 100, 100A-100E is self-retaining on the window frame assembly 200, 200A-200E (e.g., installed without the need of fasteners, such as screws, nails, or adhesive to retain the trim frame 100, 100A-100E on the window assembly 200, 200A-200E). Optionally, the trim frame 100, 100A-100E remains securely attached to the window frame assembly 200, 200A-200E even if one of the hook portions fails (e.g., breaks, does not properly catch onto the ledge portion, etc.).

Advantageously, one or more of the brickmould window trim frames 100, 100A-100E is self-centering on the window frame assembly 200, 200A-200E. For example, the independent flexing of the support wall 130, 130A-130E and hook portion 140, 140A-140E allows each to exert a force on the ledge portion 220, 220A-220C or adapter block 351D-354D, 351E-354E over which it's placed, urging the trim frame to a centered position over the window frame assembly (or over the window trim frame assembly coupled to the spacer block).

Advantageously, one or more of the brickmould window trim frames 100, 100A-100E is easy to install. For example, installation can be done by hand, optionally does not require the use of tools, and can be performed by a single individual, therefore significantly reducing the time and labor for providing a brickmould trim as part of a window installation. Such reduction in time and labor can allow the window installer to complete the window installation project much faster than with conventional brickmould trim (e.g., complete the installation in about 5-10 minutes rather than 2 hours or more), allowing the installer to complete more jobs per day using the brickmould window trim frame. Additionally, the ease of installing the trim frame advantageously allows a lower skilled worker to install it, and therefore at lower cost, freeing up a higher skilled worker for other work.

The brickmould window trim frame 100, 100A-100E can come in a variety of profiles, shapes and widths, thereby allowing the installer to change the look of a window by using a different shaped trim frame 100, 100A-100E. In one implementation, a portion of the trim frame 100, 100A-100E defines a window sill when coupled to the window frame assembly 200, 200A-200E. In another implementation at least a portion of the trim frame 100, 100A-100E (e.g., side portions) can define shutters (e.g., ornamental shutters) on either side of the window frame assembly 200, 200A-200E. In another implementation, the trim frame 100, 100A-100E can be applied to the interior side (e.g., room facing side) of the window frame assembly 200, 200A-200E as well to the exterior side (e.g., outdoor facing side) of the window frame assembly 200, 200A-200E.

Additional Embodiments

In some embodiments, a brickmould window trim frame can include a single-piece body having a left frame portion, a right frame portion, a top frame portion and a bottom frame portion. Each of the frame portions can include a brickmould body and a flange wall attached to the brickmould body and extending inwardly from the brickmould body. Each of the frame portions can further include a support wall attached to one or both of the flange wall the brickmould body and extending to a distal edge, the support wall disposed below the flange wall and extending transversely relative to the flange wall. Each of the frame portions can further include an angled wall extending from the distal edge of the support wall toward the flange wall. The single-piece body can resiliently couple to a window frame over an outer perimeter of the window frame assembly so that the angled wall contacts a portion of the window frame assembly, the single-piece body configured to be installed on the window frame assembly by hand.

Some embodiments include the brickmould window trim frame of any one or more preceding embodiments, wherein the angled wall extends at an acute angle from the distal edge of the support wall toward the flange wall so that a cross-section of the flange wall, support wall and angled wall is generally c-shaped.

Some embodiments include the brickmould window trim frame of any one or more preceding embodiments, wherein the single-piece body is made of a thermoplastic material.

Some embodiments include the brickmould window trim frame of any one or more preceding embodiments, wherein the single-piece body is made of polyvinyl chloride (PVC).

Some embodiments include the brickmould window trim frame of any one or more preceding embodiments, wherein the support wall extends generally perpendicular relative to the flange wall.

Some embodiments include the brickmould window trim frame of any one or more preceding embodiments, wherein the support wall extends at an acute angle relative to the flange wall so that the support wall flexes away from the flange wall while the single-piece body is installed on a window frame assembly until the angled wall snaps over the outer perimeter ledge.

Some embodiments include the brickmould window trim frame of any one or more preceding embodiments, wherein the single-piece body is self-centering relative to the window frame assembly when the single-piece body is coupled to the window frame assembly.

Some embodiments include the brickmould window trim frame of any one or more preceding embodiments, wherein the bottom frame portion defines a window sill when the single-piece body is coupled to the window frame assembly.

Some embodiments include the brickmould window trim frame of any one or more preceding embodiments, wherein one or more of the flange wall, support wall and angled wall allows the single-piece body to self-retain on the window frame assembly without additional support.

Some embodiments include the brickmould window trim frame of any one or more preceding embodiments, wherein one or more of the flange wall, support wall and angled wall provides a snap sound when the single-piece body is coupled to the window frame assembly to indicate the single-piece body has fully coupled to the window frame assembly.

Some embodiments include the brickmould window trim frame of any one or more preceding embodiments, wherein the flange walls of the left frame portion, right frame portion, top frame portion and bottom frame portion are joined together.

Some embodiments include the brickmould window trim frame of any one or more preceding embodiments, wherein the flange walls are jointed together by a weld.

Some embodiments include the brickmould window trim frame of any one or more preceding embodiments, wherein the support walls of the left frame portion, right frame portion, top frame portion and bottom frame portion are configured to flex independently of each other.

In some embodiments, a single-piece brickmould window trim frame in combination with a window frame assembly includes a single-piece body having a left frame portion, a right frame portion, a top frame portion and a bottom frame portion. Each of the frame portions can include a brickmould body and a flange wall attached to the brickmould body and extending inwardly from the brickmould body. Each of the frame portions can further include a support wall attached to one or both of the flange wall the brickmould body and extending to a distal edge, the support wall disposed below the flange wall and extending transversely relative to the flange wall. Each of the frame portions can further include an angled wall extending at an acute angle from the distal edge of the support wall toward the flange wall. The single-piece body can couple to a window frame over an outer perimeter ledge of the window frame so that the flange wall contacts a top surface of the outer perimeter ledge, the support wall contacts a side surface of the outer perimeter ledge, and the angled wall contacts an underside of the outer perimeter ledge, the single-piece body configured to be installed on the window frame by hand.

Some embodiments include the combination of any one or more preceding embodiments, wherein the angled wall extends at an acute angle from the distal edge of the support wall toward the flange wall so that a cross-section of the flange wall, support wall and angled wall is generally c-shaped.

Some embodiments include the combination of any one or more preceding embodiments, wherein the single-piece body is made of a thermoplastic material.

Some embodiments include the combination of any one or more preceding embodiments, wherein the support wall extends generally perpendicular relative to the flange wall.

Some embodiments include the combination of any one or more preceding embodiments, wherein the support wall extends at an acute angle relative to the flange wall so that the support wall flexes away from the flange wall while the single-piece body is installed on a window frame until the angled wall snaps over the outer perimeter ledge.

Some embodiments include the combination of any one or more preceding embodiments, wherein the single-piece body is self-centering relative to the window frame when the single-piece body is coupled to the window frame.

Some embodiments include the combination of any one or more preceding embodiments, wherein the bottom frame portion defines a window sill when the single-piece body is coupled to the window frame.

Some embodiments include the combination of any one or more preceding embodiments, wherein one or more of the flange wall, support wall and angled wall allows the single-piece body to self-retain on the window frame without additional support.

Some embodiments include the combination of any one or more preceding embodiments, wherein one or more of the flange wall, support wall and angled wall provides a snap sound when the single-piece body is coupled to the window frame to indicate the single-piece body has fully coupled to the window frame.

Some embodiments include the combination of any one or more preceding embodiments, wherein the support walls of the left frame portion, right frame portion, top frame portion and bottom frame portion are configured to flex independently of each other.

In some embodiments, a brickmould window trim frame can include a single-piece body having a left frame portion, a right frame portion and a top frame portion. Each of the frame portions comprises a brickmould body, a support wall extending generally transversely to the brickmould body to a distal edge located past a bottom surface of the brickmould body, and a hook portion extending from the distal edge of the support wall. The single-piece body is configured to resiliently couple to a window frame assembly over an outer perimeter of the window frame assembly so that the hook portion contacts a portion of the window frame assembly, the single-piece body configured to be installed on the window frame assembly by hand.

Some embodiments include the brickmould window trim frame of any one or more preceding embodiments, wherein the single-piece body further comprises a bottom frame portion attached to the left and right frame portions.

Some embodiments include the brickmould window trim frame of any one or more preceding embodiments, wherein the single-piece body further comprises a flange wall attached to the brickmould body and extending inwardly from the brickmould body, a proximal end of the support wall attached to the flange wall, wherein the flange wall contacts a top surface of the outer perimeter when the single-piece body is coupled to the window frame assembly.

Some embodiments include the brickmould window trim frame of any one or more preceding embodiments, wherein the hook portion is an angled wall that extends at an acute angle from the distal edge of the support wall toward the flange wall so that a cross-section of the flange wall, support wall and angled wall is generally c-shaped.

Some embodiments include the brickmould window trim frame of any one or more preceding embodiments, wherein the support wall extends at an acute angle relative to the flange wall so that the support wall flexes away from the flange wall while the single-piece body is installed on a window frame assembly until the angled wall snaps over the outer perimeter ledge.

Some embodiments include the brickmould window trim frame of any one or more preceding embodiments, wherein the hook portion comprises an angled wall extending at an angle relative to the support wall from a distal edge of the support wall toward the brickmould body.

Some embodiments include the brickmould window trim frame of any one or more preceding embodiments, wherein an outer perimeter surface of the brickmould body is substantially coplanar with the support wall.

Some embodiments include the brickmould window trim frame of any one or more preceding embodiments, further comprising a flushmount member removably coupleable to distal ends of the left and right frame members at an end of the single-piece body opposite the top frame portion, the flushmount member having a flex spring configured to be inserted within an accessory groove of the window frame to couple the flushmount member to the window frame assembly.

Some embodiments include the brickmould window trim frame of any one or more preceding embodiments, wherein an outer perimeter surface of the brickmould body extends past an outer perimeter of a nail fin of the window frame assembly, the body further comprising a wall extending from an underside of the brickmould body toward the nail fin, said wall disposed inward from the outer perimeter surface of the brickmould body to cover a space between the brickmould body and the nail fin.

Some embodiments include the brickmould window trim frame of any one or more preceding embodiments, wherein the single-piece body is made of a thermoplastic material.

Some embodiments include the brickmould window trim frame of any one or more preceding embodiments, wherein the single-piece body is self-centering relative to the window frame assembly when the single-piece body is coupled to the window frame assembly.

Some embodiments include the brickmould window trim frame of any one or more preceding embodiments, wherein the bottom frame portion defines a window sill when the single-piece body is coupled to the window frame assembly.

Some embodiments include the brickmould window trim frame of any one or more preceding embodiments, wherein one or more of the support wall and hook portion allows the single-piece body to self-retain on the window frame assembly without additional support.

Some embodiments include the brickmould window trim frame of any one or more preceding embodiments, wherein one or more of the support wall and hook portion provides a snap sound when the single-piece body is coupled to the window frame assembly to indicate the single-piece body has fully coupled to the window frame assembly.

Some embodiments include the brickmould window trim frame of any one or more preceding embodiments, wherein the brickmould body of the left frame portion, right frame portion, and top frame portion are joined together to define a single piece.

Some embodiments include the brickmould window trim frame of any one or more preceding embodiments, wherein the support walls of the left frame portion, right frame portion, and top frame portion are configured to flex independently of each other.

In some embodiments, a single-piece brickmould window trim frame in combination with a window frame assembly includes a single-piece body having a left frame portion, a right frame portion and a top frame portion. Each of the frame portions comprises a brickmould body, a support wall extending generally transversely to the brickmould body to a distal edge located past a bottom surface of the brickmould body, and a hook portion extending from the distal edge of the support wall. The single-piece body is configured to couple to a window frame assembly over an outer perimeter of the window frame assembly so that the hook portion contacts a portion of the window frame assembly, the single-piece body configured to be installed on the window frame by hand.

Some embodiments include the combination of any one or more preceding embodiments, wherein the single-piece body further comprises a bottom frame portion attached to the left and right frame portions.

Some embodiments include the combination of any one or more preceding embodiments, wherein the single-piece body further comprises a flange wall attached to the brickmould body and extending inwardly from the brickmould body, a proximal end of the support wall attached to the flange wall, wherein the flange wall contacts a top surface of the outer perimeter ledge when the single-piece body is coupled to the window frame assembly.

Some embodiments include the combination of any one or more preceding embodiments, wherein the hook portion is an angled wall that extends at an acute angle from the distal edge of the support wall toward the flange wall so that a cross-section of the flange wall, support wall and angled wall is generally c-shaped.

Some embodiments include the combination of any one or more preceding embodiments, wherein the support wall extends at an acute angle relative to the flange wall so that the support wall flexes away from the flange wall while the single-piece body is installed on a window frame until the angled wall snaps over the outer perimeter ledge.

Some embodiments include the combination of any one or more preceding embodiments, wherein the hook portion comprises an angled wall extending at an angle relative to the support wall from a distal edge of the support wall toward the brickmould body.

Some embodiments include the combination of any one or more preceding embodiments, wherein an outer perimeter surface of the brickmould body is substantially coplanar with the support wall.

Some embodiments include the combination of any one or more preceding embodiments, further comprising a flushmount member removably coupleable to distal ends of the left and right frame members at an end of the single-piece body opposite the top frame portion, the flushmount member having a flex spring configured to be inserted within an accessory groove of the window frame to couple the flushmount member to the window frame assembly.

Some embodiments include the combination of any one or more preceding embodiments, wherein an outer perimeter surface of the brickmould body extends past an outer perimeter of a nail fin of the window frame, the body further comprising a wall extending from an underside of the brickmould body toward the nail fin, said wall disposed inward from the outer perimeter surface of the brickmould body to cover a space between the brickmould body and the nail fin.

Some embodiments include the combination of any one or more preceding embodiments, wherein the single-piece body is self-centering relative to the window frame when the single-piece body is coupled to the window frame assembly.

Some embodiments include the combination of any one or more preceding embodiments, further comprising an adapter block having a flex spring configured to be inserted within an accessory groove of the window frame assembly to couple the adapter block to the of the window frame assembly.

Some embodiments include the combination of any of the preceding embodiments, wherein the hook portion of a frame portion of the single-piece body is configured to engage a side surface of the adaptor block to thereby couple the frame portion to the window frame assembly via the adapter block.

Some embodiments include the combination of any of the preceding embodiments, further comprising a flushmount member removably coupleable to distal ends of the left and right frame members at an end of the single-piece body opposite the top frame portion, the flushmount member having a flex spring configured to be inserted within a slot of the adapter block to couple the flushmount member to the window frame assembly via the adapter block.

Some embodiments include the combination of any of the preceding embodiments, wherein the hook portion contacts an underside of an outer perimeter ledge of the window frame assembly to resiliently couple the single-piece body to the window frame assembly.

In some embodiments, a kit includes a brickmould window trim frame and one or more adapter blocks and/or one or more flushmount members. The brickmould window trim frame has a body having a left frame portion, a right frame portion and a top frame portion. Each of the frame portions comprises a brickmould body, a support wall extending generally transversely to the brickmould body to a distal edge located past a bottom surface of the brickmould body, and a hook portion extending from the distal edge of the support wall. The single-piece body is configured to couple to a window frame assembly over an outer perimeter of the window frame assembly so that the hook portion contacts a portion of the window frame assembly, the single-piece body configured to be installed on the window frame by hand. The adapter block includes a flex spring configured to be inserted within an accessory groove of the window frame assembly to couple the adapter block to the of the window frame assembly, the adapter block also having a slot. The flushmount member includes a flex spring configured to be inserted within the slot of the adapter block to couple the flushmount member to the window frame assembly via the adapter block. The flushmount member is removably coupleable to distal ends of the left and right frame members at an end of the single-piece body opposite the top frame portion.

While certain embodiments of the invention have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a sub combination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A brickmould window trim frame, comprising:

a single-piece body having a left frame portion, a right frame portion and a top frame portion, each of the frame portions comprising a brickmould body, a support wall extending generally transversely to the brickmould body to a distal edge located past a bottom surface of the brickmould body, a flange wall attached to the brickmould body and extending inwardly from the brickmould body, a proximal end of the support wall attached to the flange wall, and a hook portion extending from the distal edge of the support wall, the hook portion being an angled wall that extends at an acute angle from the distal edge of the support wall toward the flange wall so that a cross-section of the flange wall, support wall and angled wall is generally c-shaped wherein the single-piece body is configured to resiliently couple to a window frame assembly over an outer perimeter of the window frame assembly so that the flange wall contacts a top surface of the outer perimeter and the hook portion contacts an underside of a portion of the window frame assembly when the single-piece body is coupled to the window frame assembly, the single-piece body configured to be installed on the window frame assembly by hand.

2. The brickmould window trim frame of claim 1, wherein the single-piece body further comprises a bottom frame portion attached to the left and right frame portions.

3. The brickmould window trim frame of claim 1, wherein the support wall extends at an acute angle relative to the flange wall so that the support wall flexes away from the flange wall while the single-piece body is installed on a window frame assembly until the angled wall snaps over the outer perimeter of the window frame assembly.

4. The brickmould window trim frame of claim 1, wherein the hook portion comprises an angled wall extending at an angle relative to the support wall from a distal edge of the support wall toward the brickmould body.

5. The brickmould window trim frame of claim 4, wherein an outer perimeter surface of the brickmould body is substantially coplanar with the support wall.

6. The brickmould window trim frame of claim 4, further comprising a flushmount member removably coupleable to distal ends of the left and right frame members at an end of the single-piece body opposite the top frame portion, the flushmount member having a flex spring configured to be inserted within an accessory groove of the window frame to couple the flushmount member to the window frame assembly.

7. The brickmould window trim frame of claim 1, wherein an outer perimeter surface of the brickmould body extends past an outer perimeter of a nail fin of the window frame assembly, the body further comprising a wall extending from an underside of the brickmould body toward the nail fin, said wall disposed inward from the outer perimeter surface of the brickmould body to cover a space between the brickmould body and the nail fin.

8. The brickmould window trim frame of claim 1, wherein the single-piece body is made of a thermoplastic material.

9. The brickmould window trim frame of claim 1, wherein the single-piece body is self-centering relative to the window frame assembly when the single-piece body is coupled to the window frame assembly.

10. The brickmould window trim frame of claim 1, wherein the bottom frame portion defines a window sill when the single-piece body is coupled to the window frame assembly.

11. The brickmould window trim frame of claim 1, wherein one or more of the support wall and hook portion allows the single-piece body to self-retain on the window frame assembly without additional support.

12. The brickmould window trim frame of claim 1, wherein one or more of the support wall and hook portion provides a snap connection when the single-piece body is coupled to the window frame assembly to indicate the single-piece body has fully coupled to the window frame assembly.

13. The brickmould window trim frame of claim 1, wherein the brickmould body of the left frame portion, right frame portion, and top frame portion are joined together to define a single piece.

14. The brickmould window trim frame of claim 1, wherein the support walls of the left frame portion, right frame portion, and top frame portion are configured to flex independently of each other.

15. In combination with a window frame assembly, a single-piece brickmould window trim frame comprising:

a single-piece body having a left frame portion, a right frame portion and a top frame portion, each of the frame portions comprising:

a brickmould body, a support wall extending generally transversely to the brickmould body to a distal edge located past a bottom surface of the brickmould body, and a hook portion extending from the distal edge of the support wall toward the window frame assembly;

wherein the single-piece body is configured to couple to a window frame assembly over an outer perimeter of the window frame assembly so that the hook portion contacts a portion of the window frame assembly and so that the single-piece body is spaced apart from a nail-fin of the window frame assembly, the single-piece body configured to be installed on the window frame by hand.

16. The combination of claim 15, wherein the single-piece body further comprises a bottom frame portion attached to the left and right frame portions.

17. The combination of claim 15, wherein the single-piece body further comprises a flange wall attached to the brickmould body and extending inwardly from the brickmould body, a proximal end of the support wall attached to the flange wall, wherein the flange wall contacts a top surface of the outer perimeter of the window frame assembly when the single-piece body is coupled to the window frame assembly.

18. The combination of claim 17, wherein the hook portion is an angled wall that extends at an acute angle from the distal edge of the support wall toward the flange wall so that a cross-section of the flange wall, support wall and angled wall is generally c-shaped.

19. The combination of claim 18, wherein the support wall extends at an acute angle relative to the flange wall so that the support wall flexes away from the flange wall while the single-piece body is installed on a window frame until the angled wall snaps over the outer perimeter of the window frame assembly.

20. The combination of claim 15, wherein the hook portion comprises an angled wall extending at an angle relative to the support wall from a distal edge of the support wall toward the brickmould body.

21. The combination of claim 20, wherein an outer perimeter surface of the brickmould body is substantially coplanar with the support wall.

22. The combination of claim 20, further comprising a flushmount member removably coupleable to distal ends of the left and right frame members at an end of the single-piece body opposite the top frame portion, the flushmount member having a flex spring configured to be inserted within an accessory groove of the window frame to couple the flushmount member to the window frame assembly.

23. The combination of claim 15, wherein an outer perimeter surface of the brickmould body extends past an outer perimeter of a nail fin of the window frame assembly, the body further comprising a wall extending from an underside of the brickmould body toward the nail fin, said wall disposed inward from the outer perimeter surface of the brickmould body to cover a space between the brickmould body and the nail fin.

24. The combination of claim 15, wherein the single-piece body is self-centering relative to the window frame when the single-piece body is coupled to the window frame assembly.

25. The combination of claim 15, further comprising an adapter block having a flex spring configured to be inserted within an accessory groove of the window frame assembly to couple the adapter block to the of the window frame assembly.

26. The combination of claim 25, wherein the hook portion of a frame portion of the single-piece body is configured to engage a side surface of the adaptor block to thereby couple the frame portion to the window frame assembly via the adapter block.

27. The combination of claim 25, further comprising a flushmount member removably coupleable to distal ends of the left and right frame members at an end of the single-piece body opposite the top frame portion, the flushmount member having a flex spring configured to be inserted within a slot of the adapter block to couple the flushmount member to the window frame assembly via the adapter block.

28. The combination of claim 15, wherein the hook portion contacts an underside of an outer perimeter of the window frame assembly to resiliently couple the single-piece body to the window frame assembly.

* * * * *